US012331504B2

(12) United States Patent
Nunneley et al.

(10) Patent No.: US 12,331,504 B2
(45) Date of Patent: Jun. 17, 2025

(54) YIELD LINK BRACE CONNECTOR

(71) Applicant: Simpson Strong-Tie Company Inc., Pleasanton, CA (US)

(72) Inventors: Mary Nunneley, Danville, CA (US); Patrick McManus, Fort Collins, CA (US)

(73) Assignee: Simpson Strong-Tie Company Inc., Pleasanton, CA (US)

( * ) Notice: Subject to any disclaimer, the term of this patent is extended or adjusted under 35 U.S.C. 154(b) by 280 days.

(21) Appl. No.: 18/124,749

(22) Filed: Mar. 22, 2023

(65) Prior Publication Data

US 2024/0318419 A1 Sep. 26, 2024

(51) Int. Cl.
*E04B 1/00* (2006.01)
*E04B 1/24* (2006.01)

(52) U.S. Cl.
CPC .... *E04B 1/2403* (2013.01); *E04B 2001/2415* (2013.01)

(58) Field of Classification Search
CPC ..... E04B 1/00; E04B 1/19; E04B 1/22; E04B 1/24; E04B 1/2403; E04B 2001/2415
See application file for complete search history.

(56) References Cited

U.S. PATENT DOCUMENTS 6,837,010 B2 * 1/2005 Powell ..... E04H 9/0237 403/174
7,225,588 B2 * 6/2007 Nakamura ..... F16F 7/00 52/167.3
9,593,504 B2 * 3/2017 Marinovic ..... E04H 9/0237
10,006,202 B2 * 6/2018 Kimura ..... E04B 1/98
11,346,121 B2 * 5/2022 McManus ..... E04B 1/2403
12,180,743 B2 * 12/2024 Sitler ..... E04H 9/024
2005/0005539 A1 * 1/2005 Nakamura ..... E04H 9/0237 52/167.3
2011/0232221 A1 * 9/2011 Tsai ..... E04H 9/0237 29/897.3
2012/0233955 A1 * 9/2012 Tsai ..... E04H 9/0237 52/655.1

(Continued)

FOREIGN PATENT DOCUMENTS

WO 2009124985 10/2009
WO 2021050955 3/2021

OTHER PUBLICATIONS

International Search Report and Written Opinion dated Dec. 22, 2023 in International Patent Application No. PCT/US2023/064822.

*Primary Examiner* — Chi Q Nguyen
(74) *Attorney, Agent, or Firm* — Pearl Cohen Zedek Latzer Baratz LLP

(57) ABSTRACT

A lateral bracing system incudes a frame and a brace assembly. The brace assembly may include at least one diagonal brace affixed to the frame by gusset plates. The diagonal brace may be affixed to the gusset plates at one or both ends by a yield link assembly. The yield link assembly may include various numbers of stacked fuse plates, depending on the required design strength of the lateral bracing system. Each fuse plate may include first and second ends, bolted respectively to the diagonal brace and gusset plate, and a central yield region including one or more mechanical fuses. The mechanical fuses are configured to distribute the inelastic strains throughout the yield region.

20 Claims, 20 Drawing Sheets

(56) References Cited

U.S. PATENT DOCUMENTS

| | | | | |
|---|---|---|---|---|
| 2013/0139452 | A1* | 6/2013 | Tsai | E04B 1/98 52/655.1 |
| 2014/0020311 | A1* | 1/2014 | Richard | E04H 9/14 52/167.3 |
| 2014/0059950 | A1* | 3/2014 | Marinovic | E04H 9/024 52/167.3 |
| 2016/0356033 | A1* | 12/2016 | Houghton | E04B 1/2403 |
| 2022/0333397 | A1 | 10/2022 | Richards | |

* cited by examiner

YIELD LINK BRACE CONNECTOR

BACKGROUND OF THE INVENTION

Field of the Invention

The present invention relates to hysteretic damping for structures used in single or multi-story constructions, and in particular to a bracing system constructed to provide a high degree of energy dissipation through hysteretic damping along with high initial stiffness so that energy is dissipated within a single or multi-story construction.

Description of the Related Art

Deformations to structural components due to natural phenomena such as seismic activity and high winds can have devastating effects on the structural integrity of light-framed constructions. Lateral forces generated during such natural phenomena may cause the top portion of a frame or structure to move laterally with respect to a lower portion, which movement can result in damage or structural failure and, in some instances, collapse of the building.

It is known to provide a diagonal brace assembly within a frame including horizontal beams and vertical columns. Such diagonal brace assemblies including a diagonal brace connected to the frame by gusset plates at one or both ends of the diagonal brace. It is known to provide a yielding connector between the brace and gusset plate(s), wherein the yielding connector undergoes inelastic flexural deformations upon lateral loads on the frame. A benefit of these yielding connectors is that the structural integrity and/or load carrying capacity of the diagonal brace is maintained and predictable by use of an elastic-inelastic or elastic-plastic material, such as steel, in the yielding connector. Examples of such yielding connectors are provided for example in patent publications such as U.S. Pat. No. 8,683,758 B2 and U.S. Pat. No. 9,514,907 B2. In such applications, the strength and deformation capacity of the diagonal brace assembly is controlled by the strength and deformation capacity of the individual yielding connectors.

SUMMARY

Embodiments of the present invention, roughly described, relate to a lateral bracing system for use in a column/beam frame in a construction. In embodiments, the lateral bracing system includes a diagonal brace assembly comprised of a diagonal brace connected to the frame by gusset plates at one or both ends of the brace. The lateral bracing system may further include a yield link having a first end affixed to a gusset plate and a second end affixed to an end of the brace.

The lateral bracing system has sufficient stiffness and rigidity to provide a high degree of resistance to deflection under applied lateral loads. However, at lateral loads above a controllable and predictable level, the structure of the present technology provides for stable yielding of the yield links. In this way, the applied lateral loads are hysteretically dampened from the system, and a high degree of energy is dissipated, thereby preventing damage to the frame. Moreover, the energy dissipation and stable yielding of the yield links allow the frame to withstand repeated deflection under lateral loads without failure.

DETAILED DESCRIPTION

Figure 1:
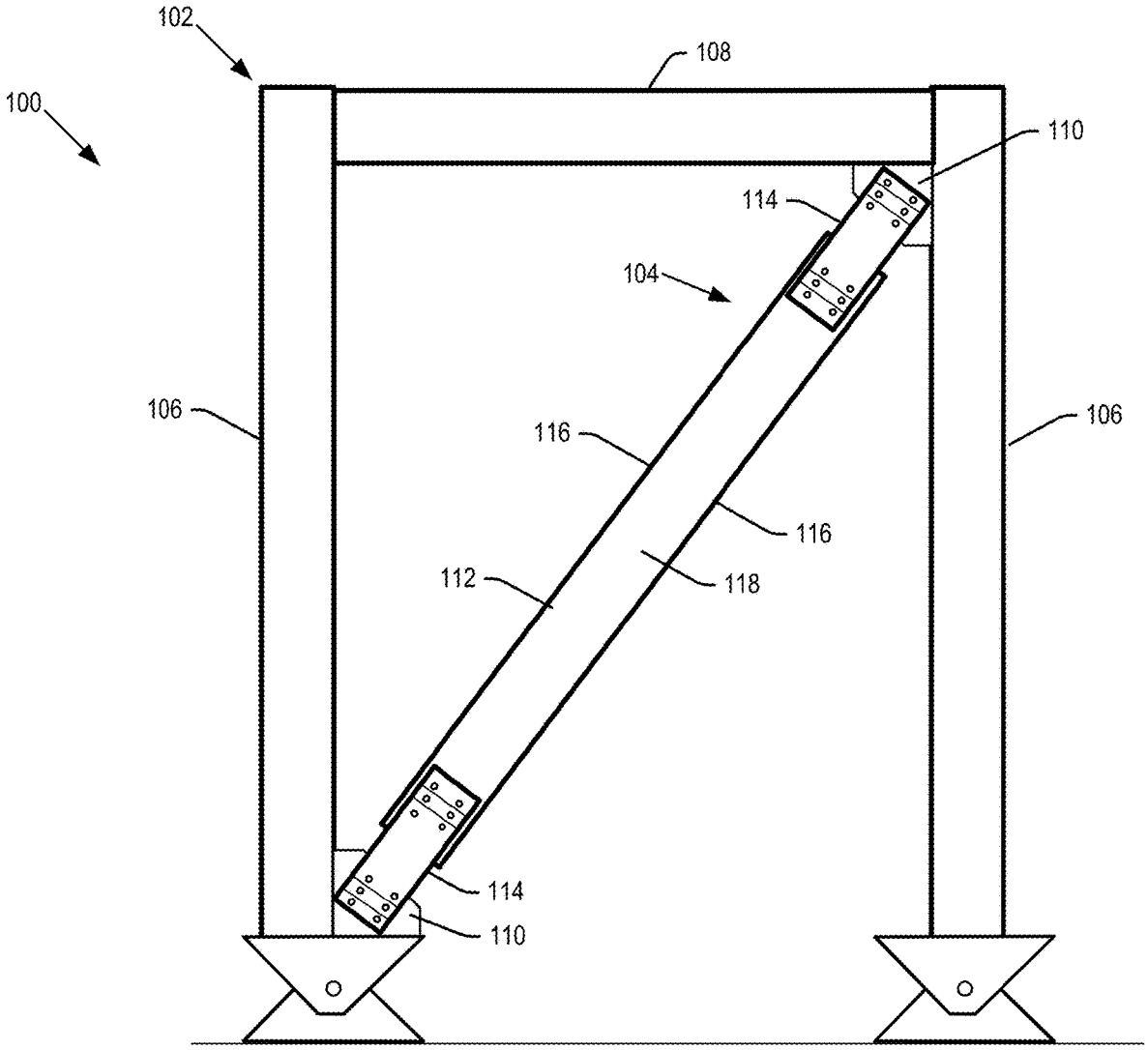
FIG. 1 is a front view of a frame and brace assembly according to an embodiment of the present technology.

The present invention will now be described with reference to the figures, which in embodiments relate to a lateral bracing system comprising a frame and a brace assembly. In embodiments, the brace assembly may comprise at least one diagonal brace affixed to the frame by gusset plates. The diagonal brace may be affixed to the gusset plates at one or both ends by a yield link assembly. In embodiments the yield link assembly may comprise various numbers of stacked fuse plates, depending on the required design strength of the lateral bracing system. Each fuse plate may include first and second ends, bolted respectively to the diagonal brace and gusset plate, and a central yield region comprising one or more mechanical fuses. The mechanical fuses are configured to distribute the inelastic strains throughout the yield region.

In addition to the stacked fuse plates, the yield link assembly may further include a cover plate limiting out of plane buckling of the fuse plates, and a U-shim between the cover plate and fuse plate stack. The U-shim provides a gap that reduces or prevents friction between the top fuse plate in the stack and the cover plate. The yield link assembly provides the lateral bracing system with a high initial stiffness while capable of effectively dissipating energy generated within the lateral bracing system under lateral loads.

It is understood that the present invention may be embodied in many different forms and should not be construed as being limited to the embodiments set forth herein. Rather these embodiments are provided so that this disclosure will be thorough and complete and will fully convey the invention to those skilled in the art. Indeed, the invention is intended to cover alternatives, modifications and equivalents of these embodiments, which are included within the scope and spirit of the invention as defined by the appended claims. Furthermore, in the following detailed description of the present invention, numerous specific details are set forth in order to provide a thorough understanding of the present invention. However, it will be clear to those of ordinary skill in the art that the present invention may be practiced without such specific details.

The terms "top" and "bottom," "upper" and "lower" and "vertical" and "horizontal," and forms thereof, as may be used herein are by way of example and illustrative purposes only, and are not meant to limit the description of the technology inasmuch as the referenced item can be exchanged in position and orientation. Also, as used herein, the terms "substantially" and/or "about" mean that the specified dimension or parameter may be varied within an acceptable manufacturing tolerance for a given application. In one embodiment, the acceptable manufacturing tolerance is ±0.15 mm, or alternatively, ±2.5% of a given dimension.

For purposes of this disclosure, a connection may be a direct connection or an indirect connection (e.g., via one or more other parts). In some cases, when a first element is referred to as being connected, affixed, mounted or coupled to a second element, the first and second elements may be directly connected, affixed, mounted or coupled to each other or indirectly connected, affixed, mounted or coupled to each other. When a first element is referred to as being directly connected, affixed, mounted or coupled to a second element, then there are no intervening elements between the first and second elements (other than possibly an adhesive or melted metal used to connect, affix, mount or couple the first and second elements).

Referring now to FIG. 1, there is shown a front view of a lateral bracing system 100 for use in single or multi-story structures. The lateral bracing system 100 includes a steel frame 102 and a yield link brace connector in the form of brace assembly 104. The steel frame may comprise a pair of vertical columns 106 and a horizontal beam 108 bolted or otherwise affixed to top portions of the vertical columns 106. Bottom portions of the vertical columns may be affixed to a foundation, if frame 102 is on a ground level, or on top of another frame 102 if on a higher level. Each of the columns 106 and beams 108 may be formed of steel having standard web and flange cross-sections, such as for example S-section or W-section, but other cross-sections are contemplated. The lengths of the columns and beams may vary in different applications. The frame 102 is preferably formed with sufficient strength so as to remain below the yield stress level for the maximum forces deliverable by the brace assembly 104, thus ensuring that yielding will be limited to the brace assembly 104 and not the frame 102.

The brace assembly 104 is provided to dissipate lateral loads on the beam and column frame 102. The brace assembly 104 works by transferring loads to the building foundation or next lower level, and by absorbing lateral loads through bending under compression and stretching under tension. These features of brace assembly 104 allow it to dissipate energy generated for example from seismic activity and wind to prevent it from being transmitted to the structure supported by frame 102.

The brace assembly 104 may be affixed to the frame 102 at gusset plates 110 welded or otherwise attached to diagonal corners of the frame 102. The brace assembly may comprise a diagonal brace 112 and one or more yield link assemblies 114 connecting one or both ends of the diagonal brace 112 to the gusset plates 110. The embodiment of FIG. 1 shows a pair of yield link assemblies 114, one at both ends of brace 112. However, there may be a single yield link assembly 114, at the top or bottom end of brace 112, in further embodiments. Details of the yield link assembly 114 are set forth below with respect to FIGS. 3-28.

The brace 112 may be a standard S-section or W-section beam, having first and second flanges 116, and a web 118 extending between the first and second flanges. Other configurations of beams are contemplated. In one further example, brace 112 may be a HSS sectional tube. In one example, the flanges 116 may have a thickness of 1 13/16 inches, though the thickness of the flanges may vary in further embodiments. In one example, the web 118 may have thicknesses of 1 inch, ¾ inch or ½ inch, though the thicknesses of the web may vary beyond that in further embodiments. The length of the brace 112 may vary depending on the lengths of the columns 106 and beam 108.

Figure 2:
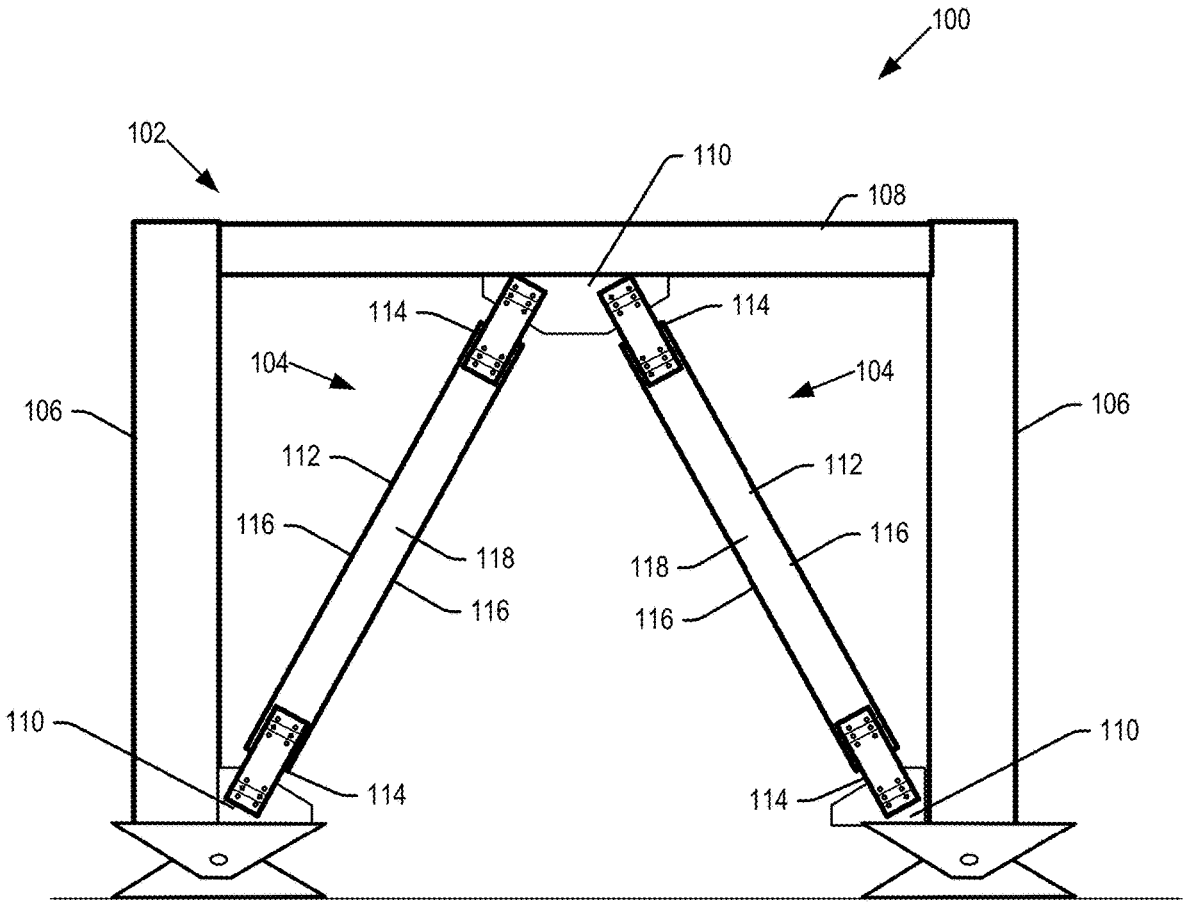
FIG. 2 is a front view of a frame and brace assembly according to an alternative embodiment of the present technology.

The embodiment of the lateral bracing system 100 of FIG. 1 includes a single brace assembly 104 extending between opposed corners of frame 102. The brace assembly 104 may alternatively have one or both ends affixed to a gusset plate 110 mounted along the length of a column 106 and/or a beam 108. FIG. 2 is a front view of such an embodiment, where the lateral bracing system 100 includes a pair of brace assemblies 104 each having a first end mounted at a corner of a column 106, and a second end mounted to a gusset plate 110 affixed to the beam 108 midway along the beam 108. Lateral bracing system 100 may have a variety of different brace assembly configurations in further embodiments. Some additional lateral bracing systems 100 are shown in FIGS. 31A-31F.

Figure 3:
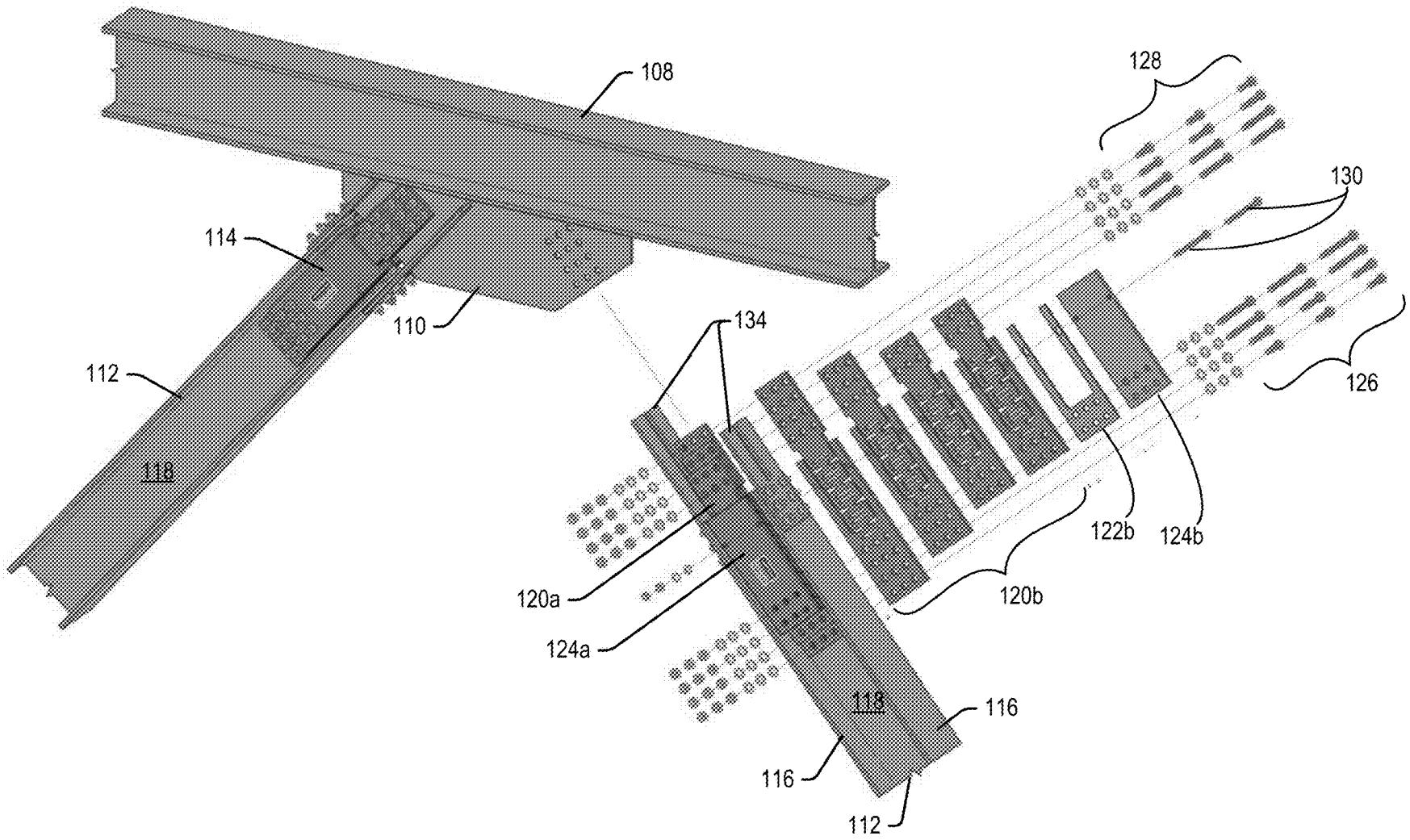
FIG. 3 is an exploded perspective view of a brace assembly according to embodiments of the present technology.

As noted above, the brace 112 may be affixed at one or both ends to frame 102 by a yield link assembly. FIG. 3 shows one of the braces 112 of FIG. 2 affixed to gusset plate 110 by an assembled yield link assembly 114, and an enlarged exploded perspective view of the yield link assembly 114 connecting the second brace 112 of FIG. 2 to the gusset plate 110. Each yield link assembly 114 comprises a first group of stacked fuse plates 120*a*, a first U-shim 122*a* (not visible in FIG. 3) and a first cover plate 124*a* (obscuring the first U-shim 122*a* from view) on a first surface of web 118 of brace 112. Each yield link assembly 114 further comprises a second group of stacked fuse plates 120*b*, a second U-shim 122*b* and a second cover plate 124*b* on a second surface of web 118.

The example of FIG. 3 includes four fuse plates 120*a* and four fuse plates 120*b* on respective surfaces of the web 118 of brace 112. As explained below, this number of fuse plates is merely one of several combinations of fuse plates that can be used. The first group of fuse plates 120*a*, the first U-shim 122*a* and the first cover plate 124*a* may be stacked in the mirror arrangement from the second group of fuse plates 120*b*, the second U-shim 122*b* and the second cover plate 124*b*. The fuse plates 120*a*, 120*b* in the respective groups need not be stacked in the mirror image of each other in further embodiments. Fuse plates 120*a*, 120*b* may also be referred to herein as simply fuse plates 120. The U-shims 122*a*, 122*b* and the cover plates 124*a* and 124*b* may also be referred to herein simply as U-shims 122 and cover plates 124, respectively.

The first and second groups of fuse plates 120, the first and second U-shims 122 and the first and second cover plate 124 may all be affixed by bolts 126 to web 118 of brace 112. In particular, the bolts 126 may pass through all plies of the fuse plates, U-shim and cover plate on the first surface of the web 118, through the web 118, and then through all plies of the fuse plates, U-shim and cover plate on the second surface of the web 118. The bolts 126 may be affixed with nuts, washers and/or other fasteners as shown in FIG. 3. Fastening schemes other than bolts may be used in further embodiments.

The first and second groups of fuse plates 120 may all be affixed by bolts 128 to gusset plate 110. In particular, the bolts 128 may pass through all plies of the fuse plates on the first surface of the gusset plate 110, through the gusset plate 110, and then through all plies of the fuse plates on the second surface of the gusset plate 110. The bolts 128 may be affixed with nuts, washers and/or other fasteners as shown in FIG. 3. Fastening schemes other than bolts may be used in further embodiments.

A third group of bolts 130 may be provided that fit through the first and second cover plates 124, U-shims 122 and legs provided on each of the fuse plates 120 in the first and second groups to secure portions of the cover plates and legs of the U-shims and fuse plates to each other as explained below.

As described below, the fuse plates 120*a*, 120*b* in the first and second groups have different lengths. Thus, some of the bolts 126, 128 fit through each of the fuse plates 120, while others of the bolts 126, 128 only fit through the longer fuse plates 120. The third group of bolts 130 fit through each of the fuse plates 120, as well as through the first and second U-shims 122 and the first and second cover plates 124.

A pair of alignment plates 134 are bolted to the first and second flanges 116 of brace 112. The pair of alignment plates 134 are bolted to the flanges 116 so that a slotted section of the plates 134 extends beyond the end of the brace 112. When the brace 112 is affixed to the gusset plate 110 by yield link assembly 114, the gusset plate 110 is received within the slot of the alignment plates 134.

Figure 4:
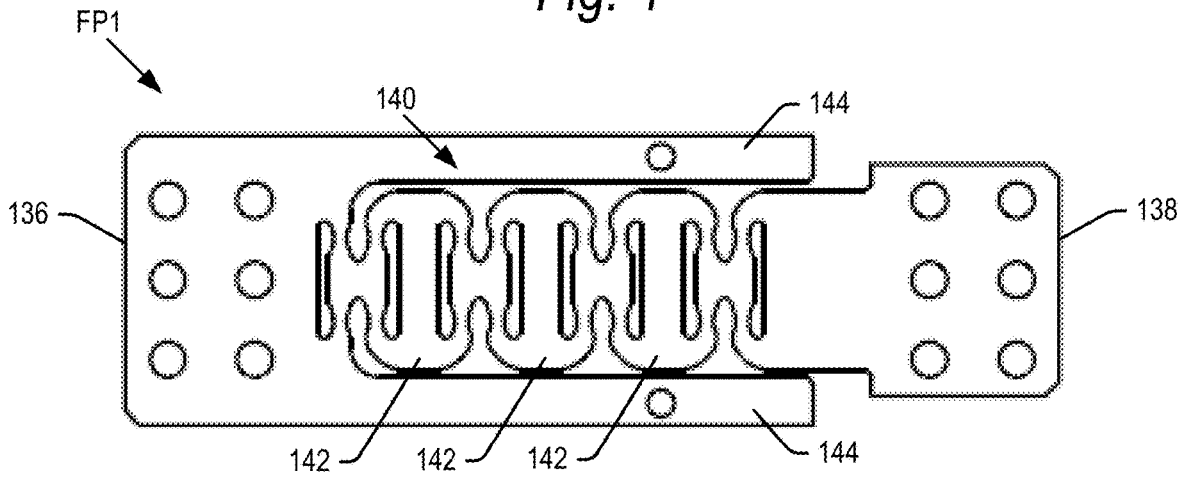
FIGS. 4-10 are front views of different fuse plate configurations according to embodiments of the present technology.

FIG. 4 is a top view of a first (small) fuse plate 120 for use in the first and second groups of fuse plates. This fuse plate 120 may be referred to herein as FP1. As shown, the first fuse plate FP1 includes a first end 136 configured to affix to the brace 112, and a second end 138 configured to affix to the gusset plate 110. Each of the first and second ends 136, 138 have six bolt holes, though there may be other numbers of bolt holes in further embodiments. The first fuse plate 120 includes a central yield region 140 between the first and second ends 136, 138 comprising one or more mechanical fuses 142 (three in the illustrated embodiment). The central yield region 140 is explained in greater detail below. The central yield region 140 may be surrounded on its top and bottom edges by legs 144 affixed to and extending from the first end 136. The legs 144 may instead be affixed to and extend from the second end 138 in further embodiments. In a further embodiment, the legs may extend from both ends 136 and 138 and meet at a gap in the middle of the central yield region. This embodiment may be used for any of the fuse plates or U-shims described herein. The legs 144 may be 1 ft, 6.25 ins long and 1.5 ins wide. The legs in each of the fuse plates 120 described below may have similar dimensions. The legs 144 each include a bolt hole for receive bolts 130 as described above.

In embodiments, FP1 may be a steel plate ¾ inch thick, 2 ft, 8.25 ins long and 10 inches wide. The first end 136 may be 5½ ins long, the second end 138 (from the end of legs 144) may be 8½ ins long, and the central yield region 140 may be 1 ft, 6.25 ins long. Each of the above dimension is by way of example and may vary in further embodiments.

In embodiments, the mechanical fuses 142 of FP1 may be configured with a design strength (maximum allowable load), φPn, of 30 kips per pair of plates FP1 (as noted, generally a yield link assembly would include a pair of each type of plate used, a first fuse plate 120*a* on one side of the brace 112 and a second fuse plate 120*b* on the opposite side of the of the brace 112). Here, phi (φ) represents a safety factor that is applied to the yield strength of the steel to ensure that it can withstand the loads it is designed for without failing, and Pn is the nominal strength of the steel member. It is understood that the design strength of the pair of FP1 plates may be greater than or less than 30 kips in further embodiments.

Figure 5:
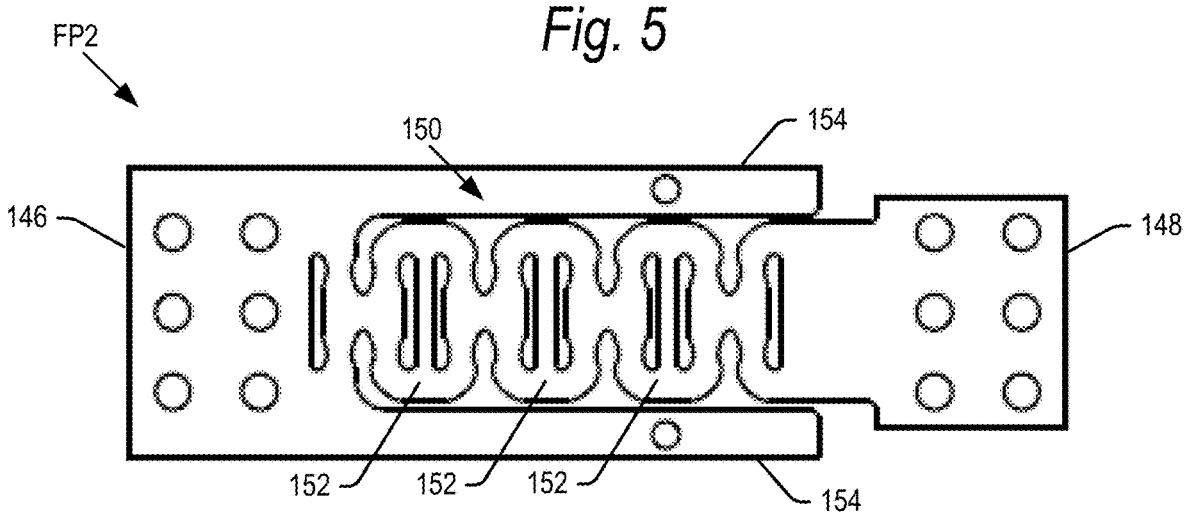

FIG. 5 is a top view of a second (small) fuse plate 120 for use in the first and second groups of fuse plates. This fuse plate 120 may be referred to herein as FP2. As shown, the second fuse plate FP2 includes a first end 146 configured to affix to the brace 112, and a second end 148 configured to affix to the gusset plate 110. The second fuse plate may have an identical construction to FP1, except that the corners of FP1 may be beveled and the corners of FP2 may not be beveled. The corners of FP1 and/or FP2 may be beveled or not beveled in further embodiments. FP2 may have a central yield region 150 with mechanical fuses 152, and legs 154 along the top and bottom edges of the central yield region. In embodiments, the mechanical fuses 152 of FP2 may be configured with a design strength, φPn, of 60 kips per pair of plates FP2. It is understood that the design strength of the pair of FP2 plates may be greater than or less than 60 kips in further embodiments.

Figure 6:
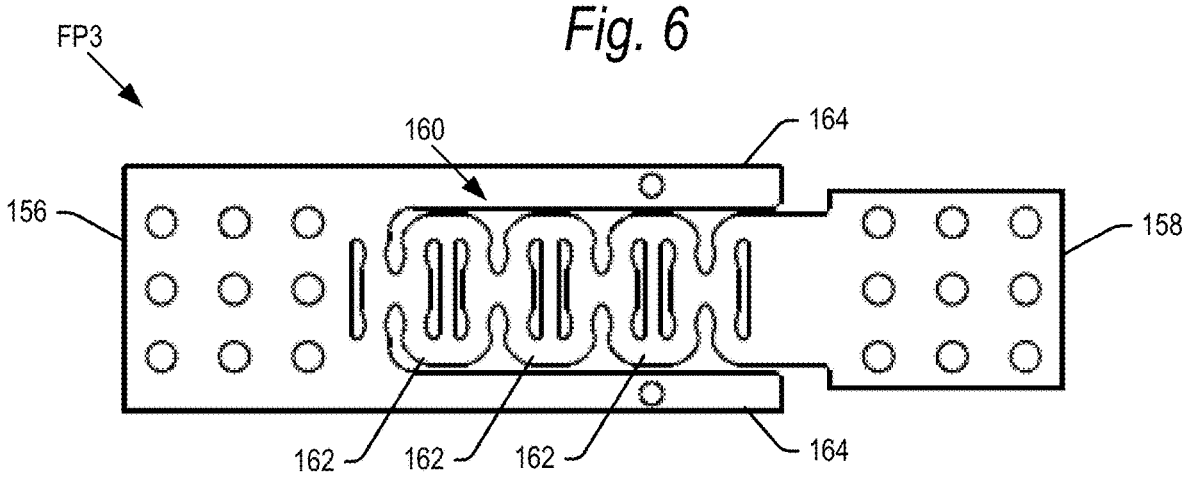

FIG. 6 is a top view of a third fuse plate 120 for use in the first and second groups of fuse plates. This fuse plate 120 may be referred to herein as FP3. As shown, the third fuse plate FP3 includes a first end 156 configured to affix to the brace 112, and a second end 158 configured to affix to the gusset plate 110. Each of the first and second ends 156, 158 have nine bolt holes, though there may be other numbers of bolt holes in further embodiments. The third fuse plate 120 includes a central yield region 160 between the first and second ends 156, 158 comprising one or more mechanical fuses 162 (three in the illustrated embodiment). The central yield region 160 may be surrounded on its top and bottom edges by legs 164 affixed to and extending from the first end 156. The legs 164 may instead be affixed to and extend from the second end 158 in further embodiments. The legs 164 each include a bolt hole for receive bolts 130 as described above.

In embodiments, FP3 may be a steel plate ¾ inch thick, 3 ft, 2.25 ins long and 10 inches wide. The first end 156 may be 8½ ins long, the second end 158 (from the end of legs 164) may be 11½ ins long, and the central yield region 160 may be 1 ft, 6.25 ins long. Each of the above dimension is by way of example and may vary in further embodiments. In embodiments, the mechanical fuses 162 of FP3 may be configured with a design strength (maximum allowable load), φPn, of 60 kips per pair of plates FP3 in a yield link assembly 114. It is understood that the design strength of the pair of FP3 plates may be greater than or less than 60 kips in further embodiments.

Figure 7:
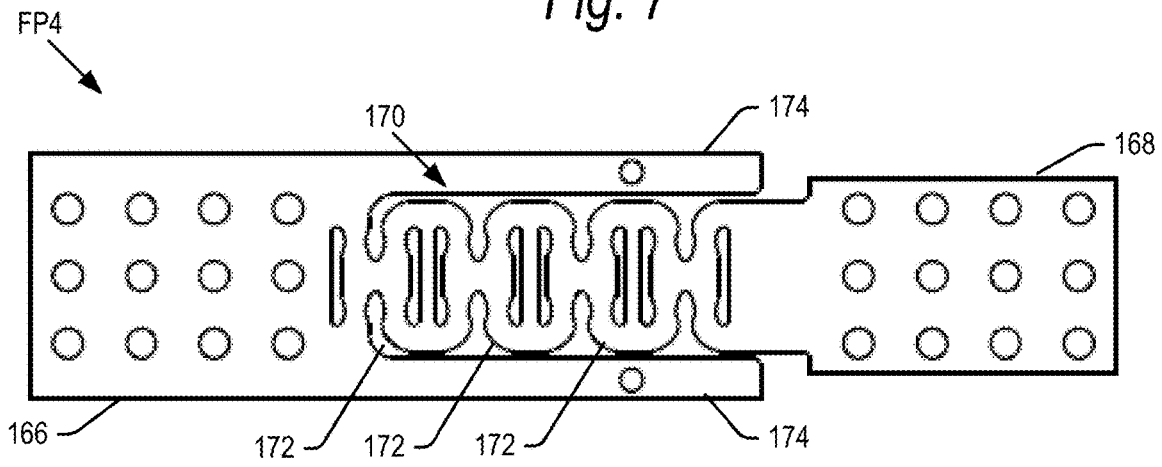

FIG. 7 is a top view of a fourth fuse plate 120 for use in the first and second groups of fuse plates. This fuse plate 120 may be referred to herein as FP4. As shown, the fourth fuse plate FP4 includes a first end 166 configured to affix to the brace 112, and a second end 168 configured to affix to the gusset plate 110. Each of the first and second ends 166, 168 have twelve bolt holes, though there may be other numbers of bolt holes in further embodiments. The fourth fuse plate 120 includes a central yield region 170 between the first and second ends 166, 168 comprising one or more mechanical fuses 172 (three in the illustrated embodiment). The central yield region 170 may be surrounded on its top and bottom edges by legs 174 affixed to and extending from the first end 166. The legs 174 may instead be affixed to and extend from the second end 168 in further embodiments. The legs 174 each include a bolt hole for receive bolts 130 as described above.

In embodiments, FP4 may be a steel plate ¾ inch thick, 3 ft, 8.25 ins long and 10 inches wide. The first end 166 may be 11½ ins long, the second end 168 (from the end of legs 174) may be 1 ft, 2½ ins long, and the central yield region 170 may be 1 ft, 6.25 ins long. Each of the above dimension is by way of example and may vary in further embodiments. In embodiments, the mechanical fuses 172 of FP4 may be configured with a design strength (maximum allowable load), φPn, of 60 kips per pair of plates FP4 in a yield link assembly 114. It is understood that the design strength of the pair of FP4 plates may be greater than or less than 60 kips in further embodiments.

Figure 8:
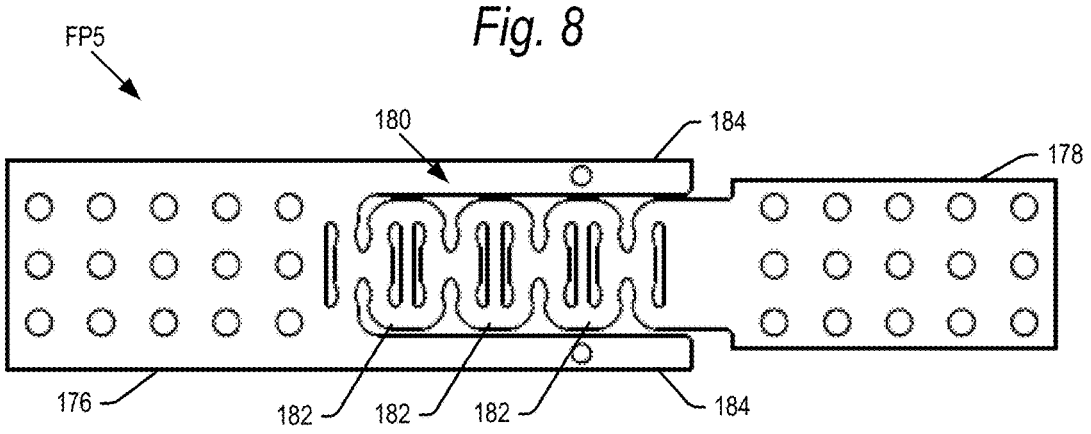

FIG. 8 is a top view of a fifth fuse plate 120 for use in the first and second groups of fuse plates. This fuse plate 120 may be referred to herein as FP5. As shown, the fifth fuse plate FP5 includes a first end 176 configured to affix to the brace 112, and a second end 178 configured to affix to the gusset plate 110. Each of the first and second ends 176, 178 have fifteen bolt holes, though there may be other numbers of bolt holes in further embodiments. The fifth fuse plate 120 includes a central yield region 180 between the first and second ends 176, 178 comprising one or more mechanical fuses 182 (three in the illustrated embodiment). The central yield region 180 may be surrounded on its top and bottom edges by legs 184 affixed to and extending from the first end 176. The legs 184 may instead be affixed to and extend from the second end 178 in further embodiments. The legs 184 each include a bolt hole for receive bolts 130 as described above.

In embodiments, FP5 may be a steel plate ¾ inch thick, 4 ft, 2.25 ins long and 10 inches wide. The first end 176 may be 1 ft, 2½ ins long, the second end 178 (from the end of legs 184) may be 1 ft, 5½ ins long, and the central yield region 180 may be 1 ft, 6.25 ins long. Each of the above dimension is by way of example and may vary in further embodiments. In embodiments, the mechanical fuses 182 of FP5 may be configured with a design strength (maximum allowable load), φPn, of 60 kips per pair of plates FP5 in a yield link assembly 114. It is understood that the design strength of the pair of FP5 plates may be greater than or less than 60 kips in further embodiments.

Figure 9:
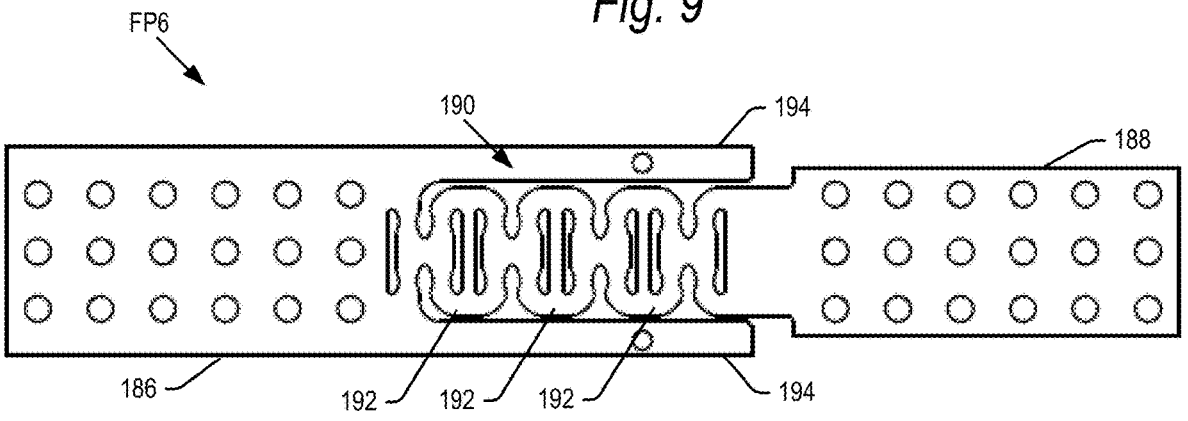

FIG. 9 is a top view of a sixth fuse plate 120 for use in the first and second groups of fuse plates. This fuse plate 120 may be referred to herein as FP6. As shown, the sixth fuse plate FP6 includes a first end 186 configured to affix to the brace 112, and a second end 188 configured to affix to the gusset plate 110. Each of the first and second ends 186, 188 have eighteen bolt holes, though there may be other numbers of bolt holes in further embodiments. The sixth fuse plate 120 includes a central yield region 190 between the first and second ends 186, 188 comprising one or more mechanical fuses 192 (three in the illustrated embodiment). The central yield region 190 may be surrounded on its top and bottom edges by legs 194 affixed to and extending from the first end 186. The legs 194 may instead be affixed to and extend from the second end 188 in further embodiments. The legs 194 each include a bolt hole for receive bolts 130 as described above.

In embodiments, FP6 may be a steel plate ¾ inch thick, 4 ft, 8.25 ins long and 10 inches wide. The first end 186 may be 1 ft, 5½ ins long, the second end 188 (from the end of legs 194) may be 1 ft, 8½ ins long, and the central yield region 190 may be 1 ft, 6.25 ins long. Each of the above dimension is by way of example and may vary in further embodiments. In embodiments, the mechanical fuses 192 of FP6 may be configured with a design strength (maximum allowable load), φPn, of 60 kips per pair of plates FP6 in a yield link assembly 114. It is understood that the design strength of the pair of FP6 plates may be greater than or less than 60 kips in further embodiments.

Figure 10:
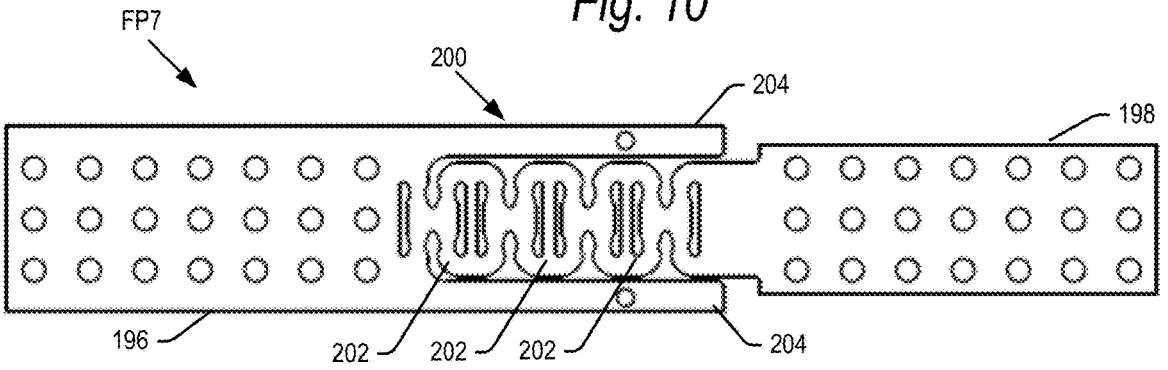

FIG. 10 is a top view of a seventh fuse plate 120 for use in the first and second groups of fuse plates. This fuse plate 120 may be referred to herein as FP7. As shown, the seventh fuse plate FP7 includes a first end 196 configured to affix to the brace 112, and a second end 198 configured to affix to the gusset plate 110. Each of the first and second ends 196, 198 have twenty-one bolt holes, though there may be other numbers of bolt holes in further embodiments. The seventh fuse plate 120 includes a central yield region 200 between the first and second ends 196, 198 comprising one or more mechanical fuses 202 (three in the illustrated embodiment). The central yield region 200 may be surrounded on its top and bottom edges by legs 204 affixed to and extending from the first end 196. The legs 204 may instead be affixed to and extend from the second end 198 in further embodiments. The legs 204 each include a bolt hole for receive bolts 130 as described above.

In embodiments, FP7 may be a steel plate ¾ inch thick, 5 ft, 2.25 ins long and 10 inches wide. The first end 196 may be 1 ft, 9½ ins long, the second end 198 (from the end of legs 204) may be 1 ft, 11½ ins long, and the central yield region 200 may be 1 ft, 6.25 ins long. Each of the above dimension is by way of example and may vary in further embodiments. In embodiments, the mechanical fuses 202 of FP7 may be configured with a design strength (maximum allowable load), Pn, of 60 kips per pair of plates FP7 in a yield link assembly 114. It is understood that the design strength of the pair of FP7 plates may be greater than or less than 60 kips in further embodiments.

Figure 11:
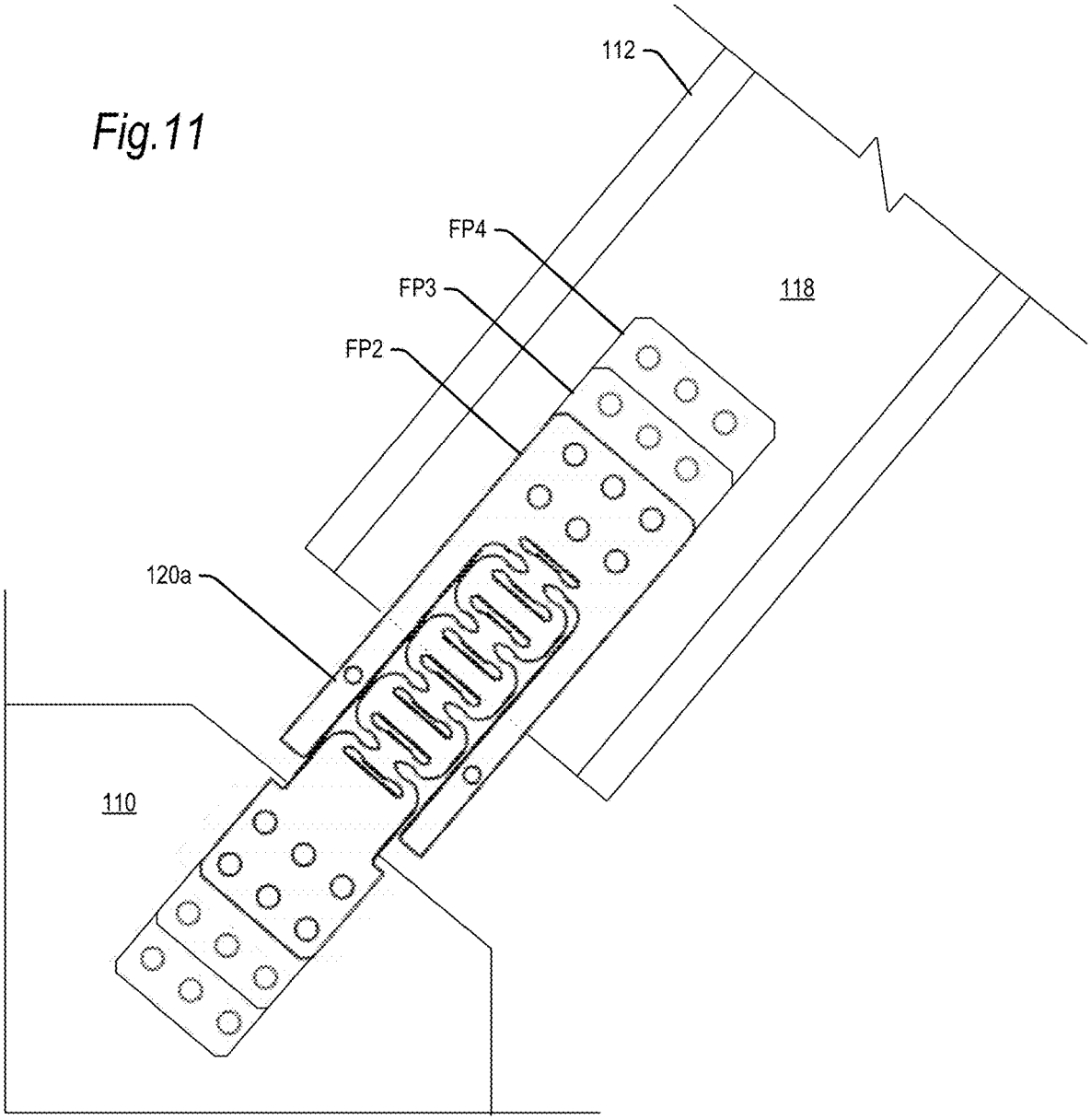
FIG. 11 is a front view of a yield link assembly according to embodiments of the present technology.

The yield link assembly 114 may include various numbers and combinations of fuse plates FP1-FP7 on top and bottom surfaces of the web 118 of brace 112. As noted, in embodiments, the same combination of fuse plates is used on both the top and bottom surfaces of web 118. FIG. 11 is a top view of a brace 112 affixed to a gusset plate 110 by the stacked fuse plates F2, F3 and F4. (the U-shim 122 and cover plate 124 are omitted from FIG. 11 for clarity). A like combination of fuse plates F2, F3 and F4 may be provided on the opposed side of web 118 (not shown).

The fuse plates may be layered on each other longest being affixed directly to the web 118, and being the same size or smaller as the plates are stacked up away from the web 118. As noted above, bolts 126 are used to affix the fuse plates to the web 118. In the embodiment shown in FIG. 11, six bolts 126 are provided through each of plates F2, F3 and F4. Three bolts 126 are provided through both of plates F3 and F4. And another set of three bolts 126 are provided through only plates F4.

As noted above, each of the pairs for fuse plates F2, F3 and F4 have design strengths of 60 kips. The use of multiple pairs are additive, such that the design strength of the embodiment shown in FIG. 11 including pairs of F2, F3 and F4 fuse plates is 60+60+60=180 kips. Under seismic, wind and other lateral loads, the yield link assembly 114 of the brace assembly 104 undergoes hysteretic damping to absorb energy by undergoing cyclic plastic deformation. The combination of fuse plates F1-F7 is selected for a desired overall design strength of yield link assembly 114. This overall design strength is based on the amount of energy to be absorbed by the lateral bracing system 100. Some further examples of yield link assembly 114, and their respective design strengths, are described below with respect to FIGS. 15-28 for different combinations of fuse plates.

Figure 12:
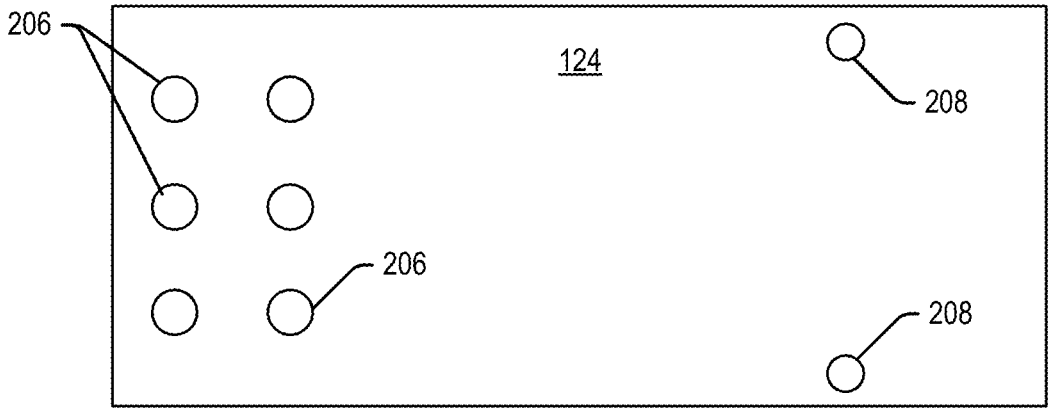
FIG. 12 is a top view of a cover plate according to embodiments of the present technology.

As noted above, the stacks of fuse plates 120 are covered by U-shims 122 and cover plates 124. The cover plates 124 are provided to confine the fuse plates 120 and limit their out-of-plane buckling. FIG. 12 is a top view of a cover plate 124. The cover plates 124 may be ¾ in thick, and have a length of 1 ft, 11¾ ins, and a width of 10 ins, though each of these dimensions may vary in further embodiments. The cover plates 124 include bolt holes 206 for receiving bolts 126, and bolt holes 208 for receiving bolts 130 that fit through the legs of each of the fuse plates.

The fuse plates 120 are longer than those provided in conventional designs and resist a larger axial force. Consequently, the cover plates 124 required redesign to optimize out-of-plane buckling. For example, it was determined that the optimal design included flat cover plates 124 as shown in FIG. 12 having the dimensions and thickness set forth above. Additionally, the number and position of bolt holes 208 (and the corresponding bolt holes in each of the legs of the fuse plates that receive bolts 130) was optimized. In particular, it is desirable to allow a degree of plastic deformation in the form of out of plane buckling of the mechanical fuses of the central yield regions of the fuse plates. However, too much out of plane buckling resulted in scraping of the fuse plates against the cover plates 124. As explained below, it is desirable to prevent such scraping. It was determined that the positions of the bolt holes 208 had a direct effect on the degree of out of plane buckling of the central yield regions of the fuse plates. If the bolt holes 208 were too close to the bolt holes 206, or multiple bolt holes 208 were used, this resulted in too much out of plane resistance of the central yield regions of the fuse plates. Conversely, if the bolt holes 208 were omitted or too far from bolt holes 206, too much out of plane buckling and scraping of the fuse plates against the cover plate occurred.

Thus, the number (one per arm) and position of the bolt holes 208 were selected to optimize the amount of out of plane buckling of the central yield regions of the fuse plates. In one embodiment, the bolt holes 208 may be spaced 14 ins from the second row of bolt holes 206, center to center, along a longitudinal axis of the cover plates 124. The second row of bolt holes 206 may be spaced 3 ins from the first row of bolt holes, center to center, along the longitudinal axis of the cover plates 124, and the center of the first row of bolt holes may be spaced 1.5 ins from the adjacent edge of the cover plate 124.

Figure 13:
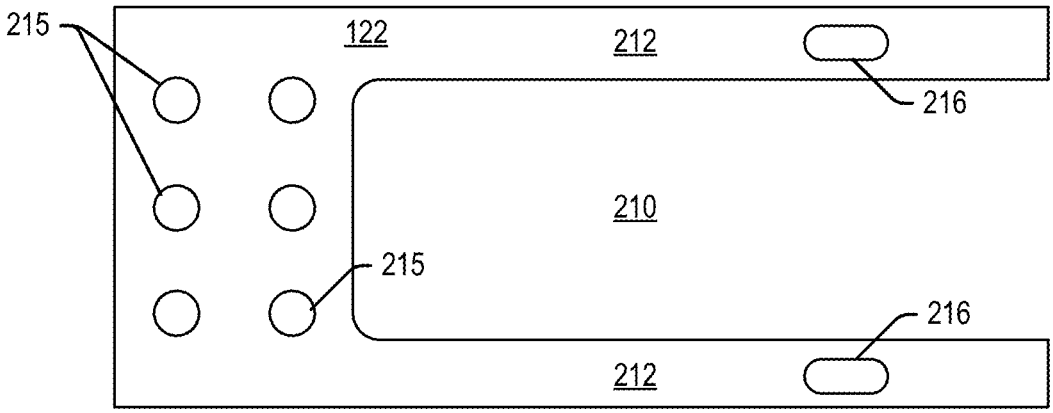
FIG. 13 is a top view of a U-shim according to embodiments of the present technology.

Additionally, it was found that the novel design of the fuse plates 120 resulted in out of plane buckling and friction with (scraping against) the cover plates 124 during plastic deformation. Consequently, the U-shims 122 were conceived to be placed between the stack of fuse plates 120 and the cover plate 124. FIG. 13 is a top view of a U-shim 122. The U-shims may be 10 gauge (0.126 ins), and have an overall length of 1 ft, 11¾ ins, and an overall width of 10 ins, though each of these dimensions may vary in further embodiments. U-shims 122 are designed with a hollow center area 210 defining legs 212 extending from one end of the U-shim 122. The legs 212 may align with edges of the stack of fuse plates, and may be 1 ft, 6.25 ins long and 1.5 ins wide. Oblong bolt holes 216 may be provided along the length of the legs 212 to receive bolts 130 as described above. U-shims may also have bolt holes 215 for receiving bolts 126 as described above. The U-shims are advantageous in that they prevent the fuse plates 120 from rubbing against the inner face of the cover plates 124, which was found to result in the fuse plates 120 using their energy capacity to overcome friction rather than plastically deforming and absorbing the energy generated from a wind or seismic event.

Figure 14:
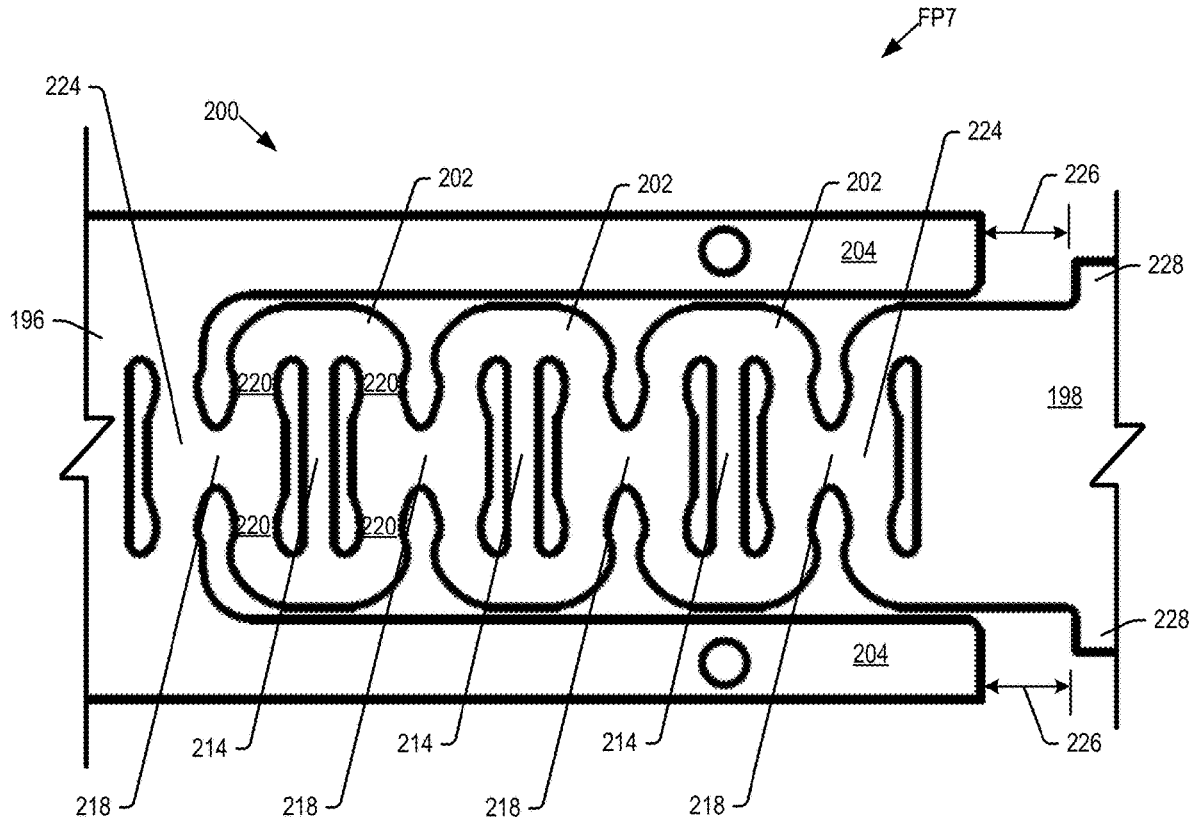
FIG. 14 is an enlarged sectional view of a central yield region according to embodiments of the present technology.

FIG. 14 is an enlarged top sectional view a central yield region. The mechanical fuses of the central yield region of the various fuse plates have geometries designed to evenly distribute the inelastic strains throughout the various portions of the mechanical fuses. The fuse plates may be oriented such that normal stresses due to flexure would substantially occur parallel to the plate material's grain (rolling direction). The grain direction can be in any orientation to the fuse plate longitudinal axis in further embodiments.

FIG. 14 illustrates the central yield region 200 between the first and second ends 196, 198 in FP7. However, in embodiments, the central yield region shown in FIG. 14 and described below may be that of any of the other fuse plates FP1-FP6 (in embodiments, FP1 may have a slightly different design as explained below). As noted above, the central yield region 200 includes a number of mechanical fuses 202. The figures show three mechanical fuses, but there may be other numbers of mechanical fuses in further embodiments, including for example 1, 2, 4, 5 or 6. There may be more in further embodiments. The individual mechanical fuses behave in series such that the overall deformation of the connection within the central yield region is the sum of the deformations of the individual mechanical fuses.

Each mechanical fuse 202 includes a generally rectangular area with rounded edges defining an open central area. A stability bar 214 is provided in the open central area, extending orthogonally to the longitudinal axis of the fuse plate. While such stability bars existed in earlier designs, the stability bars 214 of the present technology were optimized (together with the reduced diameter sections 220 explained below) for the nominal strength of the fuse plates. For example, the stability bars were designed to be wider (transverse to their length) than was previously known. For example, stability bars of earlier designs had a width of 0.30 ins while stability bars 214, in one embodiment, may have a width of between 0.35 ins to 0.4 ins, and optimally 0.375 ins. It was found that widening the stability bar prevented buckling of the stability bar before yielding of the reduced diameter sections 220 of the mechanical fuses 202.

Each of the mechanical fuses 202 may be affixed to each other and to ends 196, 198 by connective intermediate links 218. Each connective intermediate link 218 may generally be ¼ the height of the rectangular sections of mechanical fuses 202, and may space each mechanical fuse 202 from each other by about 0.25 to 0.5 ins. The connective intermediate links 218 may space the mechanical fuses by greater or lesser distances in further embodiments. Each connective intermediate link 218 may have a concave meniscus at its top and bottom to blend continuously into the generally rectangular sections of each mechanical fuse 202.

Each generally rectangular section may have reduced diameter sections 220 (numbered in one of the fuses 202) adjacent to the connective intermediate links 218, above and below the connective intermediate links. The reduced diameter sections 220 are provided to control where plastic deformation and hysteretic damping of the mechanical fuses occur. In particular, the width of the reduced diameter section is controlled relative to the width of the remaining portions of the mechanical fuses such that plastic deformation and hysteretic damping of the mechanical fuses occur at the reduced diameter sections 220. Thus, the nominal strength of the mechanical fuses and yield link assemblies is directly related to the width of the reduced diameter sections. In embodiments, the width of the reduced diameter sections for fuse plates FP2-FP7 may be between 0.8 to 0.9 ins., though they may be wider or narrower than that in further embodiments.

The central yield region 200 further includes sections 224 at opposed ends of the central yield region 200, connecting the outermost connective intermediate links to the first and second ends of the fuse plate. These sections 224 are in effect one-half of a mechanical fuse 202 as described above, including a reduced diameter section 220 configured to yield and undergo plastic deformation as described above.

As mentioned, the legs 204 extend from one end (e.g., end 196) and surround the mechanical fuses 202 at their top and bottom. In embodiments, the legs 204 may be spaced from the mechanical fuses 202 by between 0.15 ins to 0.375 ins, and more optimally 0.25 ins, and may constrain the mechanical fuses from deformation upward or downward. The length of the legs is provided such that they can minimize lateral movement of the yield link assembly 114 upon failure of one or more of the mechanical fuses.

FIG. 14 also shows a stop gap 226 between ends of each of the legs 204 and a base and a pair of abutments 228 on the gusset end 198 of the mechanical fuse. These stop gaps 126 are sized to allow plastic deformation of the mechanical fuses 202 and compression of the central yield regions 200 to a point, beyond which point the ends of one or both legs 204 contact the abutments 226 to prevent further compressive deformation of the yield link assembly 114. Thus, even upon significant plastic deformation and even failure of one or more of the mechanical fuses 202, the yield link assembly 114 may maintain a degree of structural stability in compression.

As noted, the fuse plate FP1 may have a slightly different geometry to provide an overall design strength of 30 kips. In embodiments, the reduced diameter sections 220 of the mechanical fuses 142 of fuse plate FP1 may be smaller than those of the other fuse plates. In one embodiments, the reduced diameter sections of FP1 may be 0.4 ins to 0.5 ins.

Figure 15:
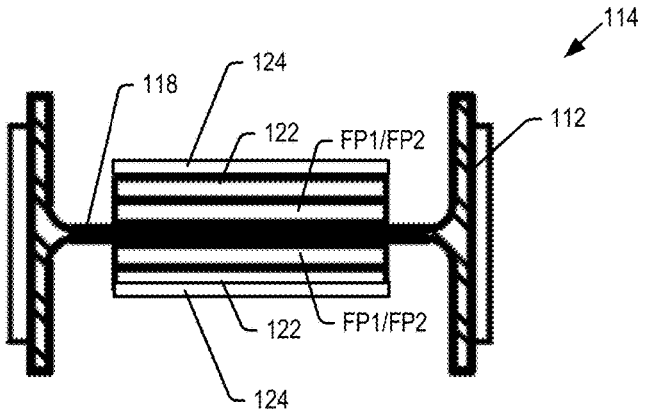
FIGS. 15-28 are cross-sectional end and side views of yield link assemblies according to embodiments of the present technology.
Figure 16:
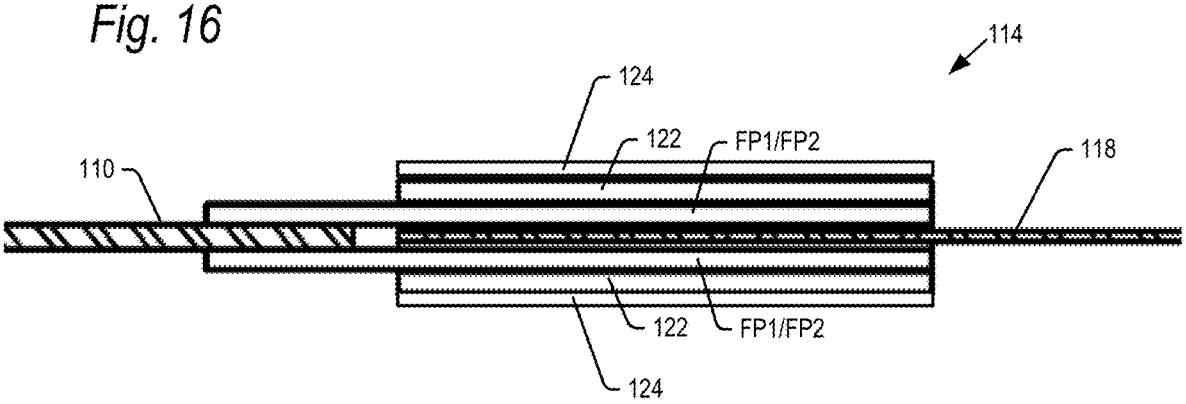

As noted above, various combinations of fuse plates may be incorporated into a given implementation of a yield link assembly 114, based on the overall design strength needed. FIGS. 15-28 show various examples of yield link assemblies, each including different numbers of fuse plates and having different design strengths. FIGS. 15 and 16 are cross-sectional end and side views of a yield link assembly 114 including a single pair of fuse plates FP1 or FP2, a pair of U-shims 122 and a pair of cover plates 124. As noted above, where the yield link assembly 114 includes a pair of fuse plates FP1, the overall design strength of the yield link assembly shown is 30 kips, and where the yield link assembly 114 includes a pair of fuse plates FP2, the overall design strength of the yield link assembly shown is 60 kips.

Figure 17:
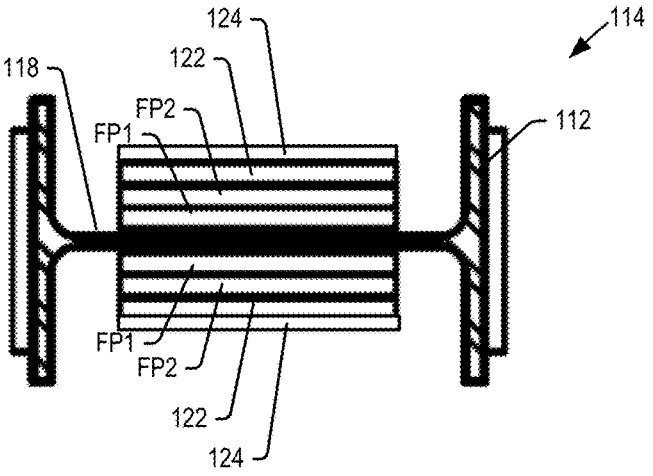
Figure 18:
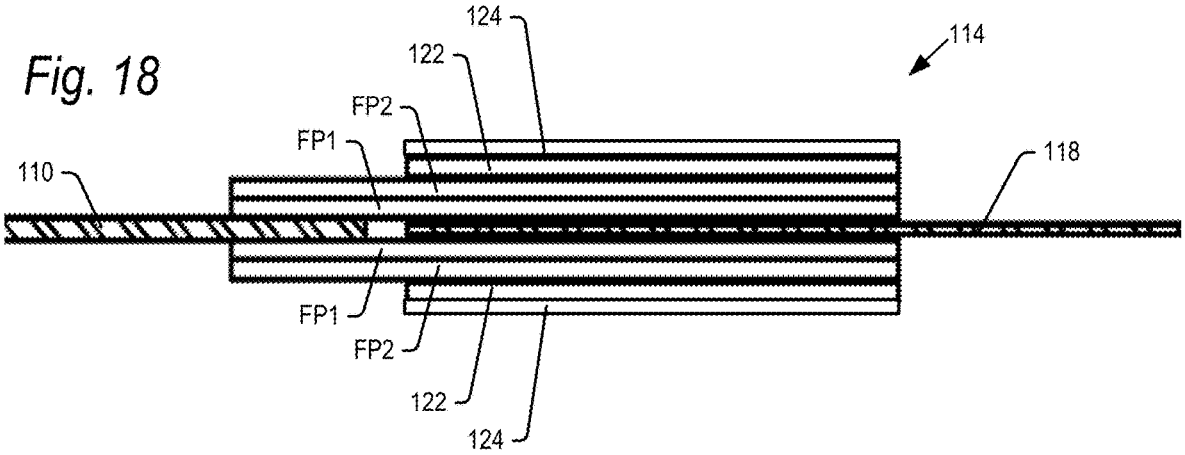

FIGS. 17 and 18 are cross-sectional end and side views of a yield link assembly 114 including a pair of fuse plates FP1, a pair of fuse plates FP2, a pair of U-shims 122 and a pair of cover plates 124. The overall design strength of the yield link assembly shown is 90 kips.

Figure 19:
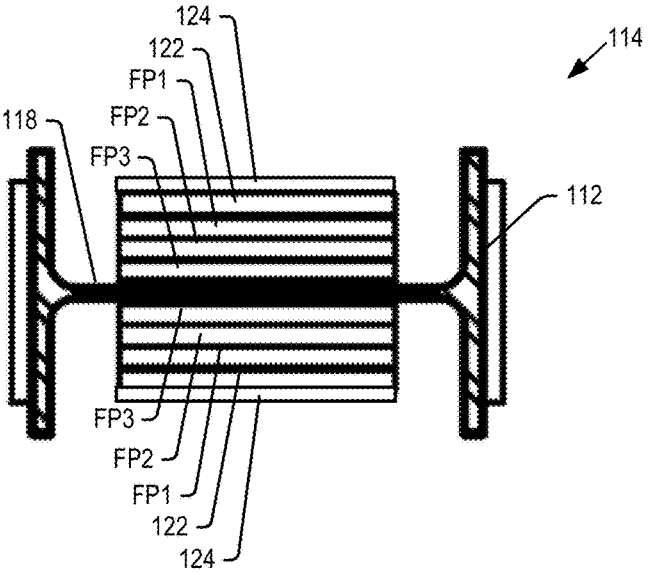
Figure 20:
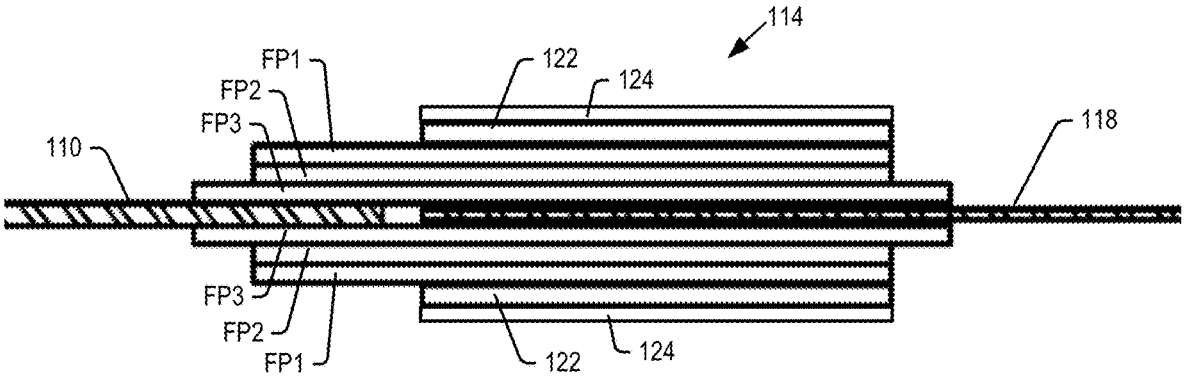

FIGS. 19 and 20 are cross-sectional end and side views of a yield link assembly 114 including a pair of fuse plates FP1, a pair of fuse plates FP2, a pair of fuse plates FP3, a pair of U-shims 122 and a pair of cover plates 124. The overall design strength of the yield link assembly shown is 150 kips.

Figure 21:
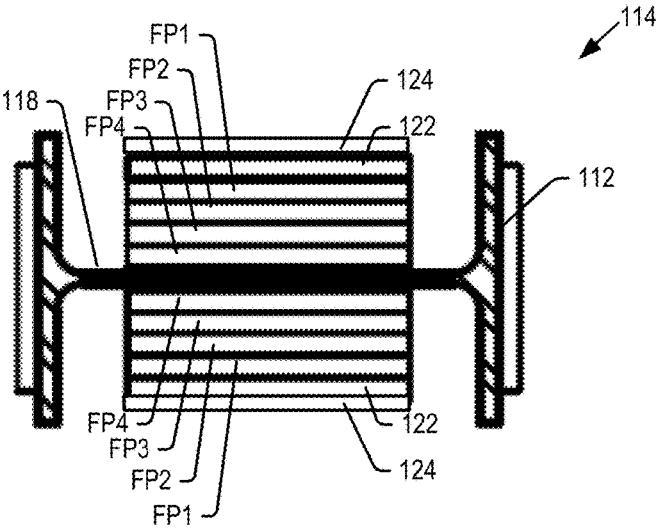
Figure 22:
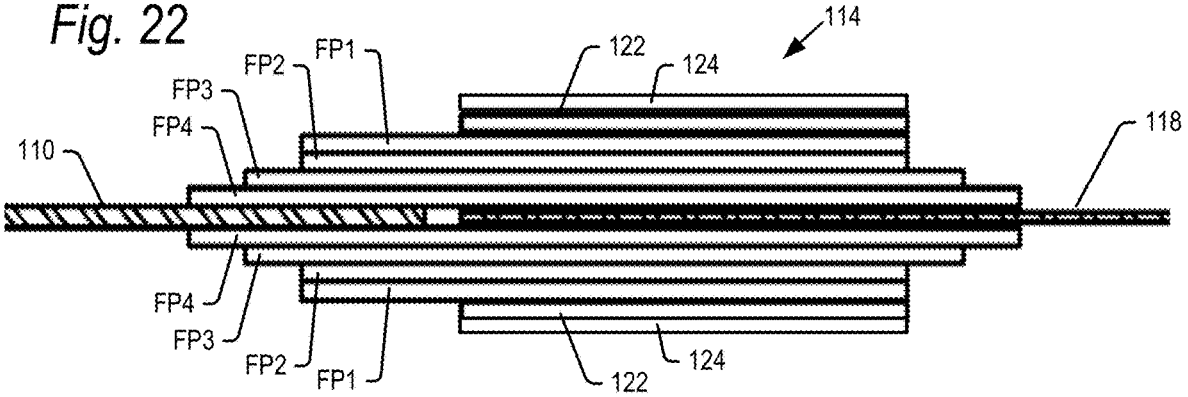

FIGS. 21 and 22 are cross-sectional end and side views of a yield link assembly 114 including a pair of fuse plates FP1, a pair of fuse plates FP2, a pair of fuse plates FP3, a pair of fuse plates FP4, a pair of U-shims 122 and a pair of cover plates 124. The overall design strength of the yield link assembly shown is 210 kips.

Figure 23:
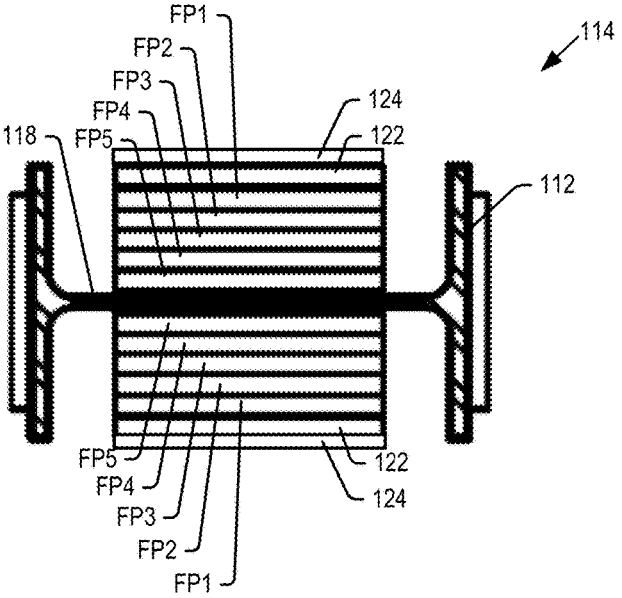
Figure 24:
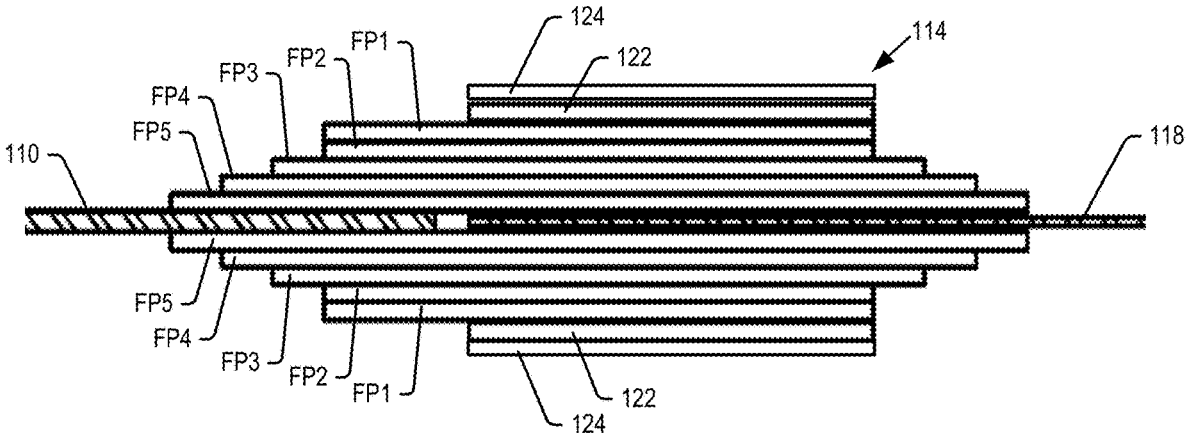

FIGS. 23 and 24 are cross-sectional end and side views of a yield link assembly 114 including a pair of fuse plates FP1, a pair of fuse plates FP2, a pair of fuse plates FP3, a pair of fuse plates FP4, a pair of fuse plates FP5, a pair of U-shims 122 and a pair of cover plates 124. The overall design strength of the yield link assembly shown is 270 kips.

Figure 25:
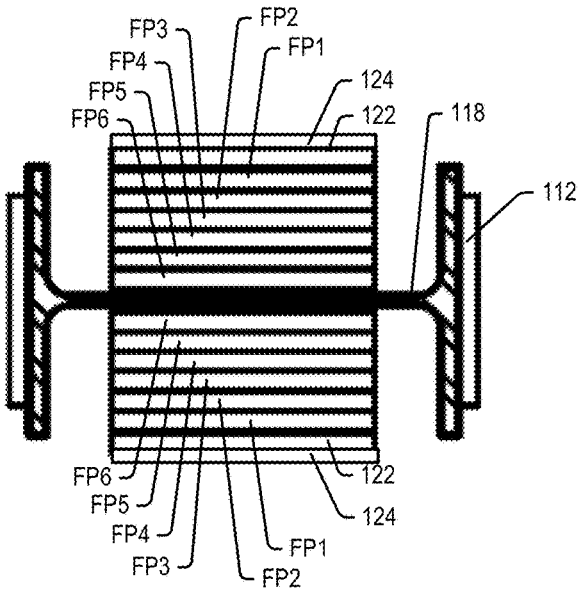
Figure 26:
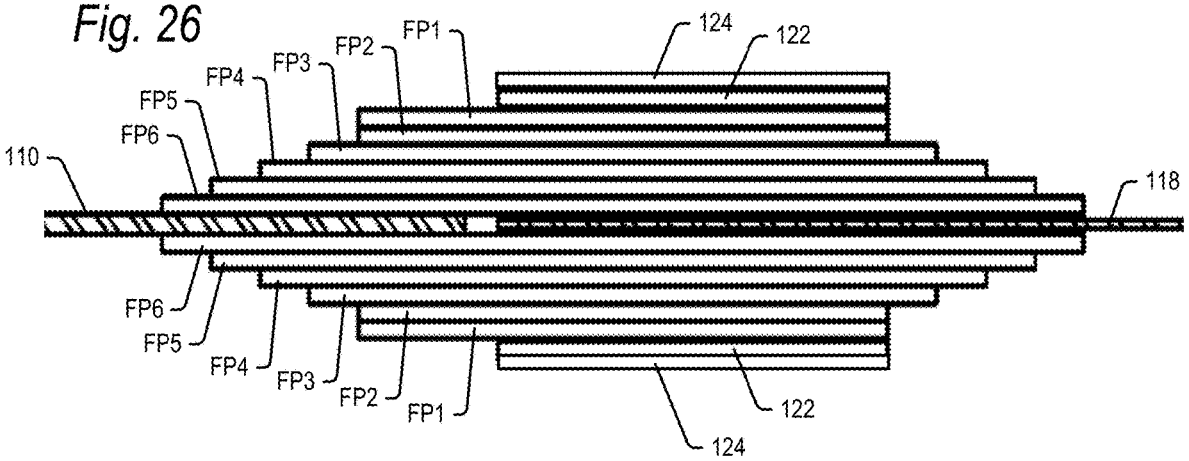
Figure 27:
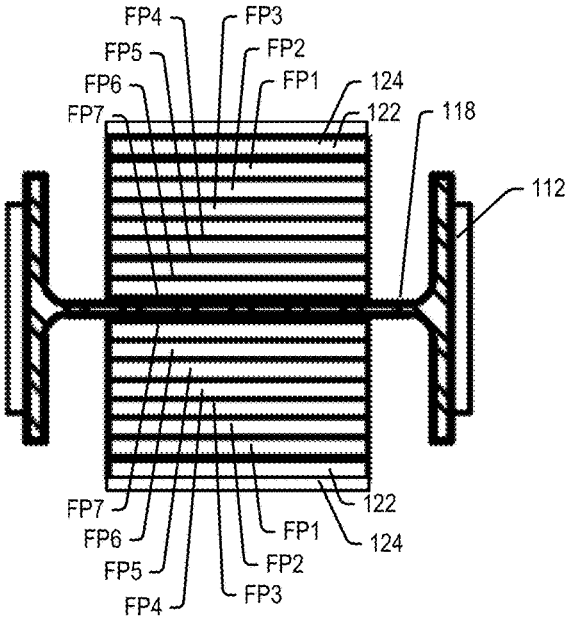
Figure 28:
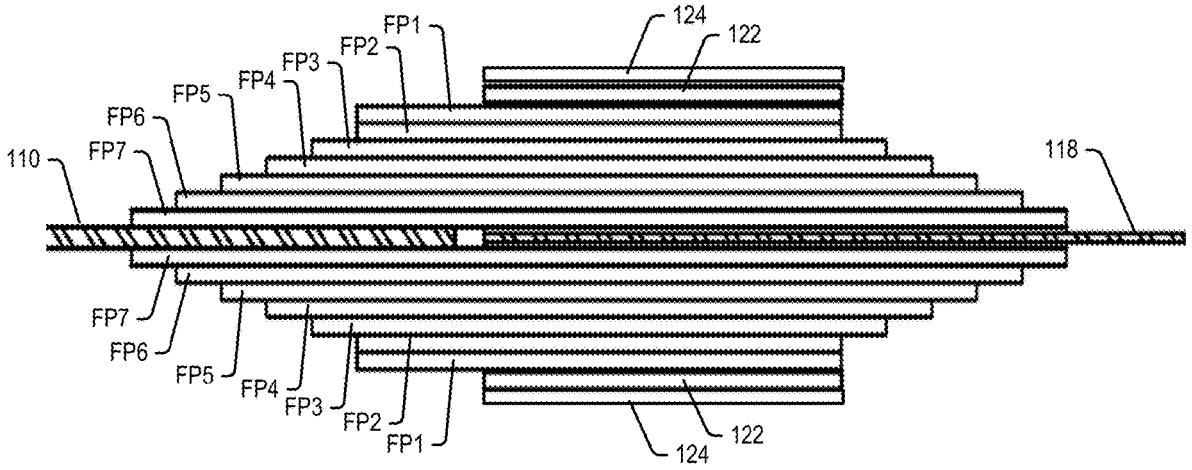

FIGS. 25 and 26 are cross-sectional end and side views of a yield link assembly 114 including a pair of fuse plates FP1, a pair of fuse plates FP2, a pair of fuse plates FP3, a pair of fuse plates FP4, a pair of fuse plates FP5, a pair of fuse plates FP6, a pair of U-shims 122 and a pair of cover plates 124. The overall design strength of the yield link assembly shown is 330 kips.

FIGS. 25 and 26 are cross-sectional end and side views of a yield link assembly 114 including a pair of fuse plates FP1, a pair of fuse plates FP2, a pair of fuse plates FP3, a pair of fuse plates FP4, a pair of fuse plates FP5, a pair of fuse plates FP6, a pair of fuse plates FP7, a pair of U-shims 122 and a pair of cover plates 124. The overall design strength of the yield link assembly shown is 390 kips.

As would be appreciated, the yield link assembly 114 may be designed with various other configurations of fuse plates to provide various other desired design strengths. In embodiments, a single stack of fuse plates (e.g., on top of the web 118) may include a single type of fuse plate FP1-FP7, or may include multiple fuse plates of the same type to provide still further configuration possibilities.

As noted, a yield link assembly 114 according to any of the embodiments and configurations described above may be provided on one end of brace 112, or both ends of brace 112. During seismic and other lateral loads, the one or more yield link assemblies 114 undergo plastic deformation, thereby preventing damage to the frame 102. Moreover, the energy dissipation and stable yielding of the one or more yield link assemblies allow the frame 102 to withstand repeated deflection under lateral loads without failure. In the event one or more of the mechanical fuses are damaged upon yielding, the yield link assembly 114 having the damaged mechanical fuse(s) may be restored to its original integrity and load bearing capabilities simply by removing and replacing the yield link assembly. The structural frame 102 remains intact and need not be replaced.

Figure 29:
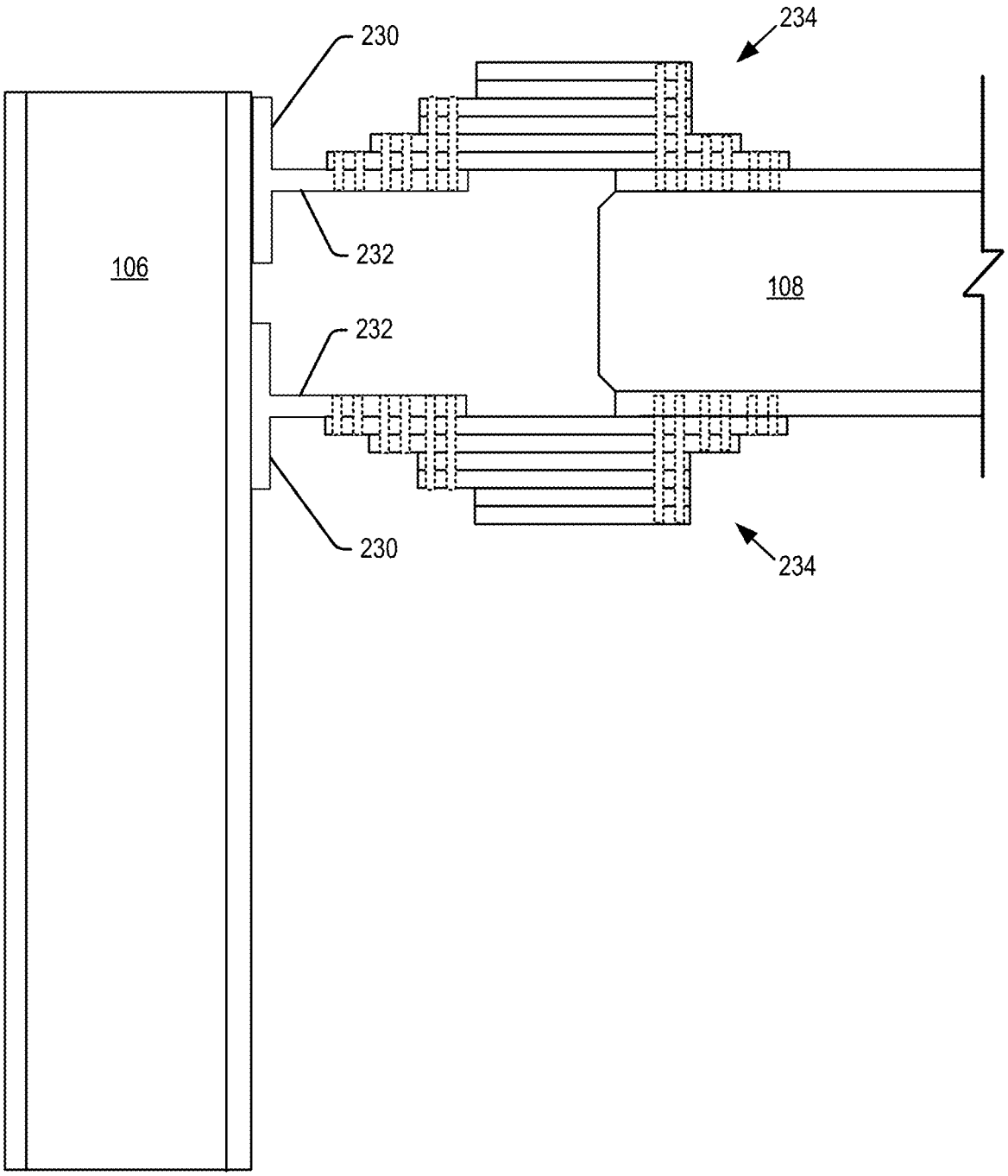
FIG. 29 shows yield link assemblies according to an alternative embodiment of the present technology connecting a beam to a column.

U.S. Pat. No. 11,299,880, entitled, "Moment Frame Connector," discloses a yield link assembly 304 coupling a column 302 and beam 304 for example in FIG. 14 of that patent. It is understood that the yield link assembly 114 of the present technology may be adapted for use to couple a beam to a column as disclosed in U.S. Pat. No. 11,299,880. Such an embodiment is shown in FIG. 29 of the present application. As shown, a column 106 may include a pair of face plates 230 affixed as by bolts to a flange of the column. These face plates 230 may each include a horizontal section 232. A first yield link assembly 234 may have fuse plates with first ends affixed to the horizontal section of the top face plate, and second ends affixed to a top flange of beam 108. A second yield link assembly 234 may have fuse plates with first ends affixed to the horizontal section of the bottom face plate, and second ends affied to a bottom flange of beam 108. The first and second yield link assemblies 234 may be identical to any of the yield link assemblies described herein, with the modification that each of the yield link assemblies 234 may include a single set of fuse plates, instead of the mirrored pair of fuse plates in yield link assemblies 114. Other features of connectors disclosed in U.S. Pat. No.

11,299,880 may also be used in the connection shown in FIG. 29. U.S. Pat. No. 11,299,880 is hereby incorporated by reference herein in its entirety.

Figure 30:
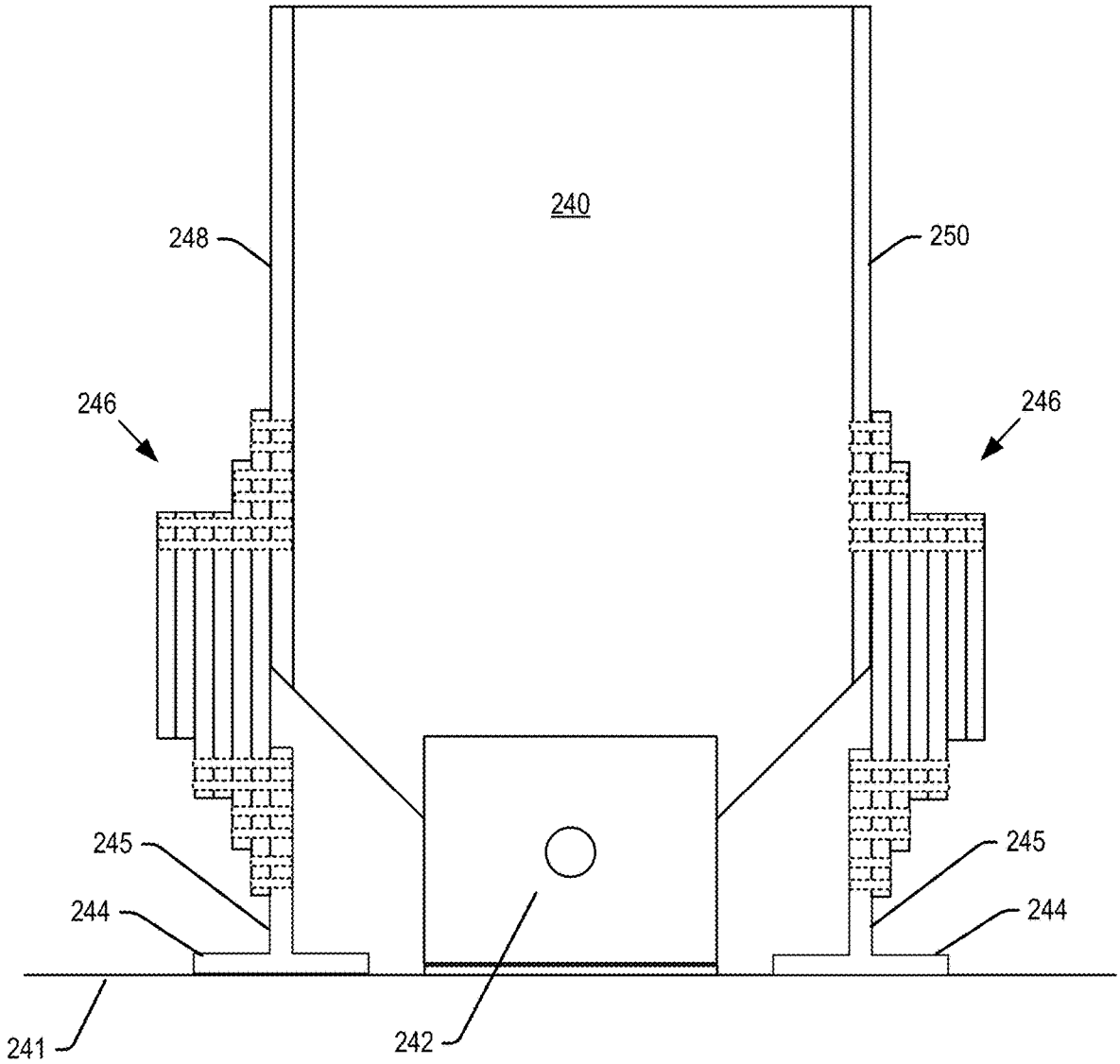
FIG. 30 shows yield link assemblies according to an alternative embodiment of the present technology connecting a moment frame to a foundation.
Figure 31C:
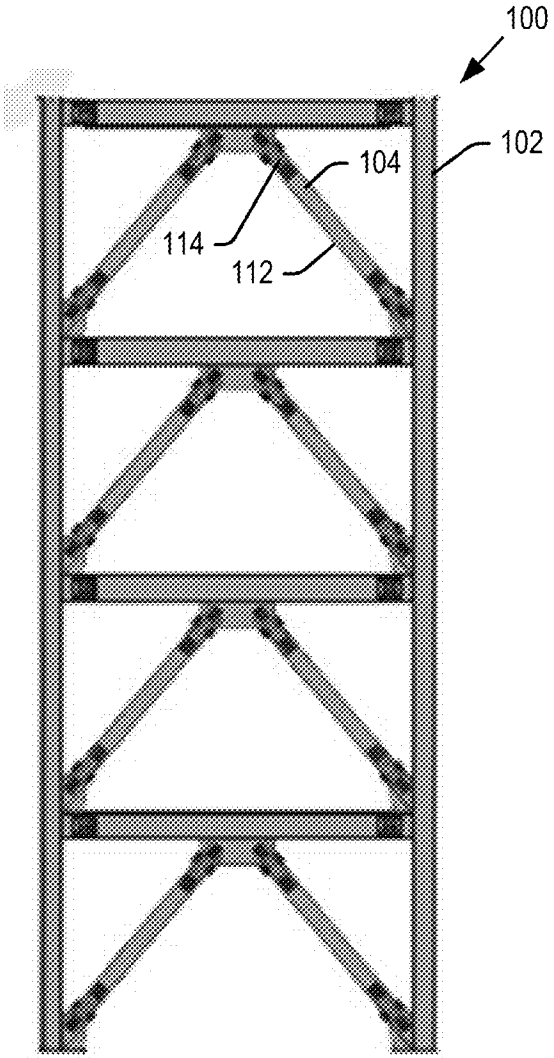
FIGS. 31A-31F are views of different multi-story lateral bracing systems each including yield link assemblies according to embodiments of the present technology.
Figure 31B:
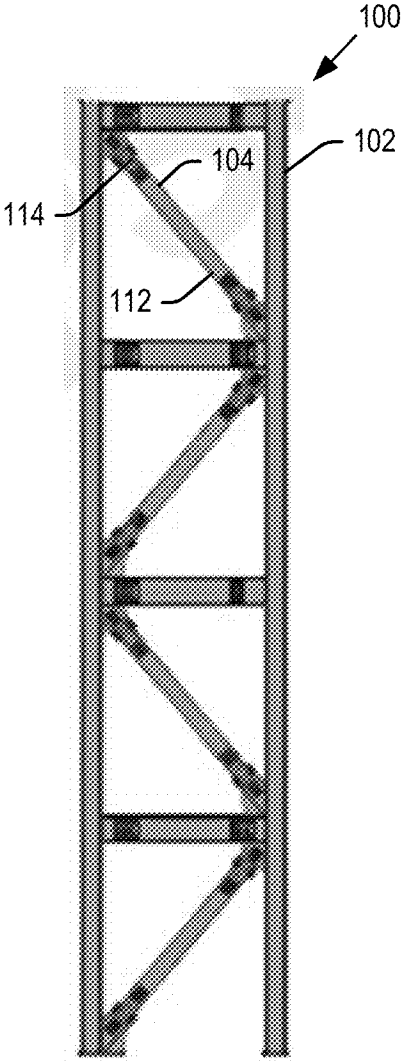
Figure 31A:
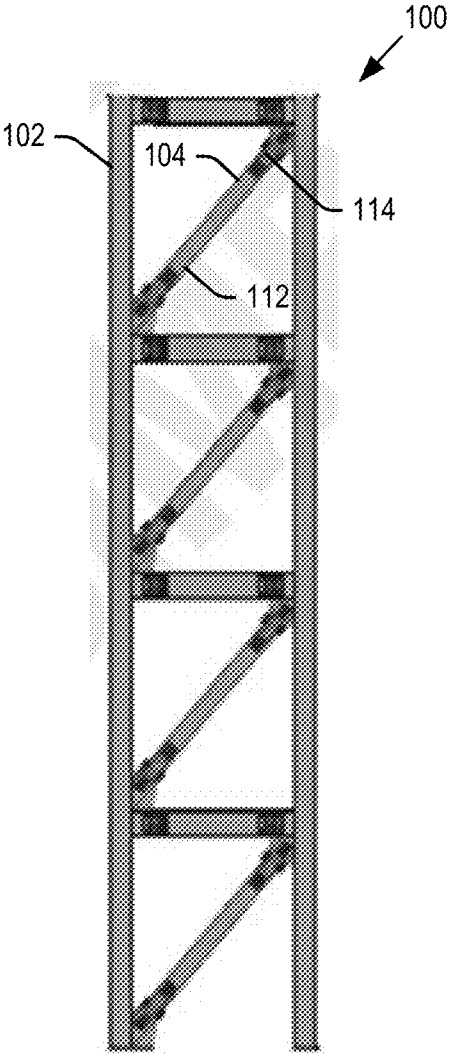
Figure 31F:
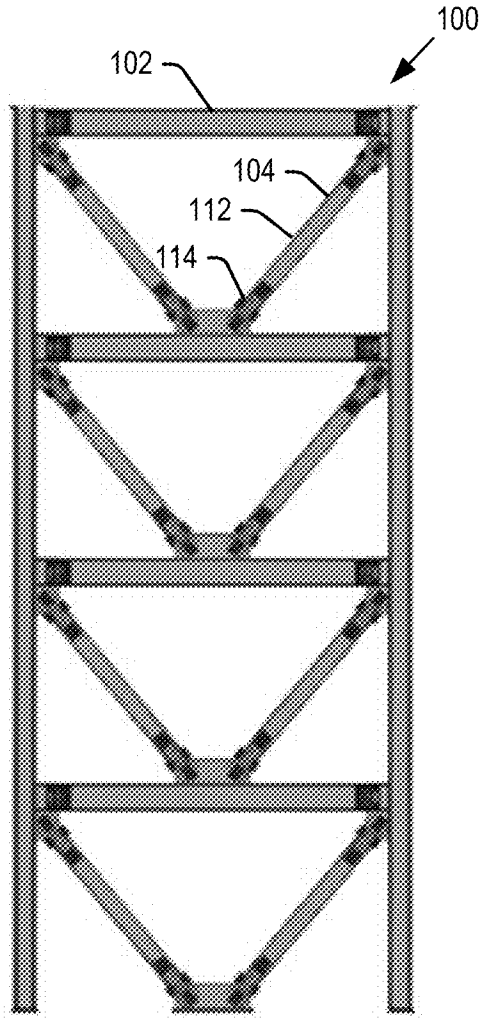
Figure 31E:
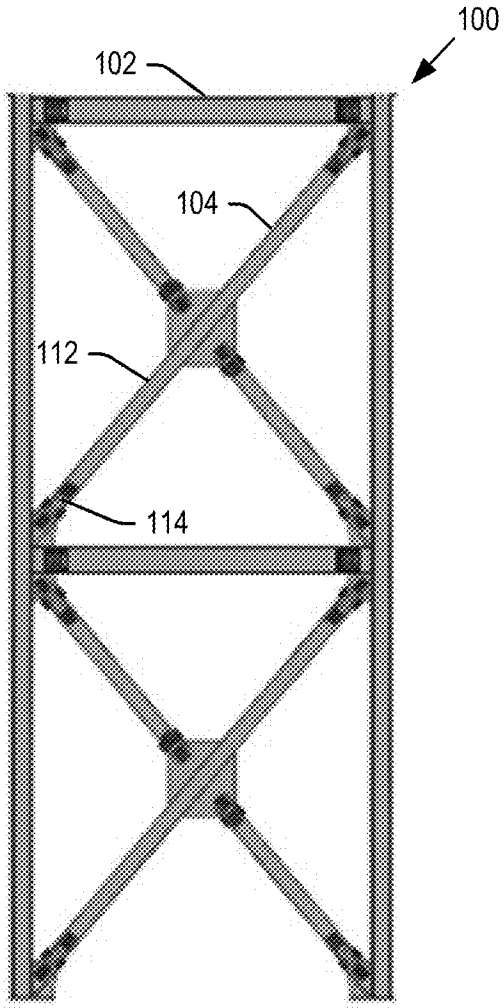
Figure 31D:
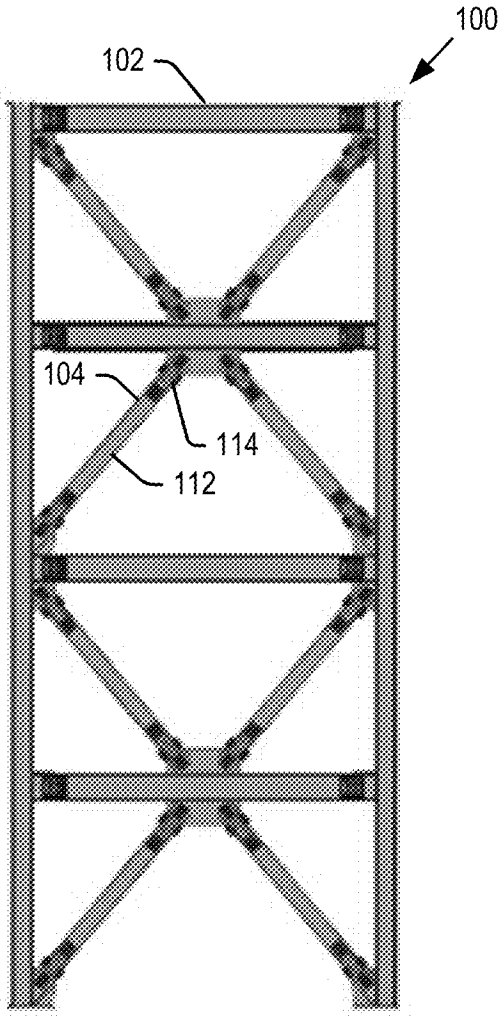

U.S. Pat. No. 11,346,102, entitled, "Moment Frame Links Wall," discloses a lateral bracing system 100 including a moment frame 101 with a central diaphragm 102, and yield links 110 on either side of the moment frame 101 affixing the moment frame 101 to a foundation. It is understood that the yield link assembly 114 of the present technology may be adapted for use to couple a moment frame to a foundation as disclosed in U.S. Pat. No. 11,346,102. Such an embodiment is shown in FIG. 30 of the present application. As shown, a moment frame 240 (such as a shear wall) may be pinned to a foundation 241 (or lower level) by pivot connector 242. A pair of face plates 244 may be affixed as by bolts to the foundation. These face plates 244 may each include a vertical section 245. A first yield link assembly 246 may have fuse plates with first ends affixed to the vertical section 245 of the left face plate 244, and second ends affixed to a flange 248 of the moment frame 240. A second yield link assembly 246 may have fuse plates with first ends affixed to the vertical section of the right face plate 244, and second ends affied to a flange 250 of the moment frame 240. The first and second yield link assemblies 246 may be identical to any of the yield link assemblies described herein, with the modification that each of the yield link assemblies 246 may include a single set of fuse plates, instead of the mirrored pair of fuse plates in yield link assemblies 114. Other features of connectors disclosed in U.S. Pat. No. 11,346,102 may also be used in the connection shown in FIG. 30. U.S. Pat. No. 11,346,102 is hereby incorporated by reference herein in its entirety.

FIGS. 31A-31F are front views of some additional lateral bracing systems 100. The systems 100 shown in FIGS. 31A-31F each include multiple stories of frames 102. Each frame 102 includes a bracing assembly 104 including a configuration of a brace 112 and multiple yield link assemblies 114 (only some of these components have reference numbers in FIGS. 31A-31F. The yield link assemblies 114 shown in FIGS. 31A-31F may be according to any of the embodiments described herein.

Although the invention has been described in detail herein, it should be understood that the invention is not limited to the embodiments herein disclosed. Various changes, substitutions and modifications may be made thereto by those skilled in the art without departing from the spirit or scope of the invention as described and defined by the appended claims.

What is claimed is:

1. A construction, comprising:
- a frame, comprising:
  - a vertical column;
  - a horizontal beam;
- a gusset plate affixed to the frame;
- a brace; and
- a yield link assembly coupling the brace to the gusset plate, the yield link assembly comprising:
  - a set of two or more fuse plates of different sizes stacked on each other, the set of two or more fuse plates each comprising one or more mechanical fuses configured to plastically deform under lateral loads on the construction, a bottommost fuse plate of the set of two or more fuse plates mounted directly on the brace;
  - a U-shim affixed to an uppermost fuse plate of the set of two or more fuse plates, the U-shim having an open central portion and legs in part defined by the open central portion, the legs aligning with edges of the set of two or more fuse plates; and
  - a cover plate affixed to the U-shim, the U-shim preventing friction between the uppermost fuse plate and the cover plate as the mechanical fuses of the set of two or more fuse plates plastically deform out of plane.

2. The construction of claim 1, wherein a set of two or more fuse plates of different sizes comprise six fuse plates of different sizes.

3. The construction of claim 1, wherein a set of two or more fuse plates of different sizes comprise a first set of two or more fuse plates of different sizes mounted on a first surface of the brace, the construction further comprising a second set of two or more fuse plates of different sizes mounted on a second surface of the brace.

4. The construction of claim 3, wherein the second set of two or more fuse plates is mounted on the second surface of the brace in a mirror configuration to the first plates mounted on the first surface of the brace.

5. The construction of claim 1, further comprising a first set of bolts, the first set of bolts mounting a first end of each fuse plate of the first set of fuse plates, the U-shim and the cover plate to the brace.

6. The construction of claim 5, further comprising a second set of bolts mounting a second end of each fuse plate of the first set of fuse plates, to the gusset plate.

7. The construction of claim 1, wherein the one or more mechanical fuses each comprise a generally rectangular geometry with rounded edges, and a plurality of reduced diameter sections, the mechanical fuses configured to plastically deform at the plurality reduced diameter sections.

8. The construction of claim 7, wherein the one or more mechanical fuses in each fuse plate each comprise a stability bar extending a length of each mechanical fuse of the one or more mechanical fuses transverse to a longitudinal axis of the fuse plate, the stability bar configured with a width such that the plurality of reduced diameter sections undergo plastic deformation before the stability bars undergoes plastic deformation.

9. The construction of claim 1, further comprising legs on each fuse plate of the set of two or more fuse plates, the legs on each fuse plate aligning with the legs of the U-shim.

10. The construction of claim 9, further comprising an abutment on each fuse plate of the set of two or more fuse plates, an end of a leg on each fuse plate spaced across from the abutment, plastic deformation of the one or more mechanical fuses along a longitudinal axis of the fuse plate compressing the one or more mechanical fuses until the end of the leg abutting against the abutment, contact of the end of the leg against the abutment preventing further compression of the fuse plate along the longitudinal axis.

11. A brace assembly mounted to a gusset plate on a frame of a construction, the brace assembly comprising:
- a brace; and
- a yield link assembly coupling the brace to the gusset plate, the yield link assembly comprising:
  - a set of two or more fuse plates of different sizes stacked on each other, the set of two or more fuse plates each comprising one or more mechanical fuses configured to plastically deform under lateral loads on the construction, a bottommost fuse plate of the set of two or more fuse plates mounted directly on the brace;
  - a U-shim affixed to an uppermost fuse plate of the set of two or more fuse plates, the U-shim having an open central portion and legs in part defined by the open central portion, the legs aligning with edges of the set of two or more fuse plates; and a cover plate affixed to the U-shim, the U-shim preventing friction between the uppermost fuse plate and the cover plate as the mechanical fuses of the set of two or more fuse plates plastically deform out of plane.

12. The brace assembly of claim 11, wherein a set of two or more fuse plates of different sizes comprise six fuse plates of different sizes.

13. The brace assembly of claim 11, wherein a set of two or more fuse plates of different sizes comprise a first set of two or more fuse plates of different sizes mounted on a first surface of the brace, the construction further comprising a second set of two or more fuse plates of different sizes mounted on a second surface of the brace.

14. The brace assembly of claim 13, wherein the second set of two or more fuse plates is mounted on the second surface of the brace in a mirror configuration to the first plates mounted on the first surface of the brace.

15. The brace assembly of claim 11, further comprising a first set of bolts, the first set of bolts mounting a first end of each fuse plate of the first set of fuse plates, the U-shim and the cover plate to the brace.

16. The brace assembly of claim 15, further comprising a second set of bolts mounting a second end of each fuse plate of the first set of fuse plates, to the gusset plate.

17. The brace assembly of claim 11, further comprising legs on each fuse plate of the set of two or more fuse plates, the legs on each fuse plate aligning with the legs of the U-shim.

18. A brace assembly mounted to a gusset plate on a frame of a construction, the brace assembly comprising:

a brace; and a yield link assembly coupling the brace to the gusset plate, the yield link assembly comprising:

a set of two or more fuse plates of different sizes stacked on each other, the set of two or more fuse plates each comprising one or more mechanical fuses configured to plastically deform under lateral loads on the construction, a bottommost fuse plate of the set of two or more fuse plates mounted directly on the brace, wherein each mechanical fuse in each fuse plate comprises:

a generally rectangular geometry with rounded edges, and a plurality of reduced diameter sections, a stability bar extending a length of each mechanical fuse of the one or more mechanical fuses transverse to a longitudinal axis of the fuse plate, the stability bar configured with a width such that the plurality of reduced diameter sections undergo plastic deformation before the stability bars undergoes plastic deformation;

a U-shim affixed to an uppermost fuse plate of the set of two or more fuse plates, the U-shim having an open central portion and legs in part defined by the open central portion, the legs aligning with edges of the set of two or more fuse plates; and a cover plate affixed to the U-shim.

19. The brace assembly of claim 18, further comprising legs on each fuse plate of the set of two or more fuse plates, the legs on each fuse plate aligning with the legs of the U-shim.

20. The brace assembly of claim 19, further comprising an abutment on each fuse plate of the set of two or more fuse plates, an end of a leg on each fuse plate spaced across from the abutment, plastic deformation of the one or more mechanical fuses along a longitudinal axis of the fuse plate compressing the one or more mechanical fuses until the end of the leg abutting against the abutment, contact of the end of the leg against the abutment preventing further compression of the fuse plate along the longitudinal axis.

* * * * *